US007857552B2

(12) United States Patent
Li

(10) Patent No.: US 7,857,552 B2
(45) Date of Patent: Dec. 28, 2010

(54) TENON JOINT TYPE SPACE LATTICE STRUCTURE

(76) Inventor: Piao-Chin Li, No. 18, 2nd Neighborhood, Jinshin Village, Sihu Township, MiaoLi County 368 (TW)

( * ) Notice: Subject to any disclaimer, the term of this patent is extended or adjusted under 35 U.S.C. 154(b) by 164 days.

(21) Appl. No.: 12/000,216

(22) Filed: Dec. 11, 2007

(65) Prior Publication Data

US 2009/0145072 A1 Jun. 11, 2009

(51) Int. Cl.
*E02D 29/02* (2006.01)

(52) U.S. Cl. ..... 405/302.4; 405/284; 52/660

(58) Field of Classification Search ..... 52/589.1–590.1, 52/592.1, 604, 169.9, 299; 249/60; 405/284, 405/285, 258.4, 302.4, 302.6, 273; 47/33, 47/65.9, 66.5, 83; 211/188, 194, 187, 190, 211/182, 134

See application file for complete search history.

(56) References Cited

U.S. PATENT DOCUMENTS 1,460,263 A * 6/1923 Ver Mehr et al. ..... 405/281
3,006,038 A * 10/1961 Sullivan, Jr. ..... 52/236.1
3,343,301 A * 9/1967 Adelman ..... 47/33
3,373,668 A * 3/1968 Moore et al. ..... 404/41
3,537,687 A * 11/1970 Adelman ..... 256/19
4,372,705 A * 2/1983 Atkinson ..... 405/19
4,869,018 A * 9/1989 Scales et al. ..... 47/33
4,884,920 A * 12/1989 Perazzi ..... 405/284
5,080,523 A * 1/1992 Steiner ..... 404/7
5,087,150 A * 2/1992 McCreary ..... 405/31
5,119,587 A * 6/1992 Waltz ..... 47/33
5,154,032 A * 10/1992 Ritter ..... 52/592.1
5,168,678 A * 12/1992 Scott et al. ..... 52/102
5,178,492 A * 1/1993 Meheen ..... 405/284
5,224,801 A * 7/1993 Quaney ..... 405/273
5,269,419 A * 12/1993 Aldeguer et al. ..... 211/188
5,291,708 A * 3/1994 Johnson ..... 52/282.2
5,406,745 A * 4/1995 Lin ..... 47/1.01 F
5,409,325 A * 4/1995 Wu ..... 404/34
5,456,555 A * 10/1995 Bokeler ..... 405/286
5,482,408 A * 1/1996 Lunardi ..... 405/286
5,901,526 A * 5/1999 Vidmar et al. ..... 52/745.09
6,202,367 B1 * 3/2001 Marino et al. ..... 52/102

(Continued)

FOREIGN PATENT DOCUMENTS

GB 2184472 A * 6/1987

(Continued)

*Primary Examiner*—Robert J Canfield
*Assistant Examiner*—Babajide Demuren
(74) *Attorney, Agent, or Firm*—Rosenberg, Klein & Lee

(57) ABSTRACT

A tenon joint type space lattice structure having a plurality of lattice units and combining pillar is provided. The lattice unit includes a convex tenon and a concave tenon groove disposed at ends of the lattice to form a tenon-and-groove structure. The tenon of one lattice unit may be embedded within an adjacent tenon groove for connecting the lattice units in series to form a continuously extended layer of lattice units. The continuous structure of lattice units forms a plane layer of a space lattice structure. The combining pillar may be passed perpendicularly through a hollow portion of a lattice unit for connecting plane layers of lattice units stacked one over the other to form a three-dimensional space lattice structure. A heavy filling material may fill the hollow portion of the structure to form a gravity structure.

6 Claims, 24 Drawing Sheets

U.S. PATENT DOCUMENTS 6,250,845 B1 * 6/2001 Deaton et al. ..... 405/33
6,394,705 B1 * 5/2002 Lefebvre ..... 405/262
2002/0164213 A1 * 11/2002 Lewis ..... 405/273
2005/0160686 A1 * 7/2005 Williams ..... 52/102
2006/0257209 A1 * 11/2006 Li ..... 405/110
2007/0036616 A1 * 2/2007 Knudson et al. ..... 405/284

FOREIGN PATENT DOCUMENTS

JP 60233217 A * 11/1985

* cited by examiner

TENON JOINT TYPE SPACE LATTICE STRUCTURE

BACKGROUND OF THE INVENTION

1. Field of the Invention

The present invention relates to a tenon joint type space lattice structure, and more particularly to a multifunctional space lattice structure having a retaining wall, a water drainage and an earth fill vegetation by jointly using a tenon joint assembling of components and a combining pillar.

2. Description of the Related Art

At present, not too many cases of using a space frame structure in civil engineering for constructing a retaining wall, a dam or a water passage of are found. There is a gravity structure that adopts concrete pre-cast lattices stacked by a transversally and longitudinally interlaced method, and its hollow portion is provided for filling crushed stones, retaining earth, and draining water. There is also a lattice frame structure that is made by wood with the same method. The rest are lattice frame structures used for the slope face of a dam, and the space frame structures cannot be used extensively in constructions of this sort mainly because the issue of materials, joints and engineering method. For instance, the combination of joints is one of the key points of the aforementioned space frame structure, but the traditional method of combining joints between two components is too complicated, not only involving a high level of difficulty in construction, but also taking up much time.

In view of the foregoing issues, the inventor of the present invention based on years of experience in the related field to conduct extensive researches and experiments, and developed an "Impact protection structure" as disclosed in R.O.C. Pat. No. 271463, a "Vegetation net body, soft framework, plus water and soil conservation engineering method" as disclosed in R.O.C. Pat. No. 284168, a "Space dam wall structure" as disclosed in R.O.C. Pat. No. 287596 and a "Truss space dam, wall structure" as disclosed in R.O.C. Pat. No. 94115608, and then further developed a space frame for civil engineering to provide an improved method for a better and practical applications.

SUMMARY OF THE INVENTION

It is a primary object of the invention to provide a tenon joint type space lattice structure to overcome the deficiency of a general space frame structure that cannot be used extensively in civil engineering structures such as retaining walls, dams and water passages due to the joint combination and construction issues, and such appropriate multifunctional space lattice structure can be used in many aspects of civil engineering, not only expediting a construction, but also using tenon joint components and combining pillars to jointly construct a space lattice structure having the functions of retaining earth, draining water and filling earth.

In order to achieve the object, a tenon joint type space lattice structure includes a predetermined quantity of lattice units and combining pillar and is characterized in that the lattice unit comprises two or more pre-molded components coupled with each other, and a convex tenon and a concave tenon groove disposed on an end of the lattice unit, and the tenon and the tenon groove form a tenon-and-groove structure, such that the tenon protruded between each component is embedded into an adjacent tenon groove and coupled with the tenon groove by a tenon joint assembling process, and the components are coupled with each other in series to constitute a continuously extended lattice unit.

The continuous lattice unit further forms a plane year of a space lattice structure, uses the combining pillar to pass through a hollow portion of the component perpendicularly, and connects the plane layers of the lattice unit in series along the direction of the height of the structure, so as to constitute a three-dimensional space lattice structure.

The present invention is characterized in that the lattice unit is manufactured in the best mode according to transmitted force, stylish appearance, construction convenience, transportation, vegetation space and economic factors. Therefore, the lattice unit includes a light hollow component made of a light material and a heavy component made of a heavy material.

The lattice unit of the heavy component is made of a heavy material such as steel concrete, steel, steel concrete and wood, etc. The heavy component requires a hollow portion at the position of the tenon for passing through a combining pillar, and the lattices of the lattice unit may or may not have a hollow portion depending on the required structural strength, but the overall constructability and cost of the manufacturing process should be taken into consideration. The manufacturing process will become simpler and easier if it is not necessary to build the hollow portion. The lattice unit of the heavy component used for the construction makes the transportation by labor more difficult due to the heavy weight, and thus a hoisting machine is required for the transportation. Furthermore, the flexibility of adjusting the tenon joint assembling process will be affected greatly. In addition to performing a precise positioning before starting the construction, it is necessary to use other accessory facilities in the tenon joint assembling to precisely construct the plane and the height of the structure, so as to prevent deviations. Further, the gravitation force produced by the mass of the lattice unit of the heavy component on the structure is one of the structural resistance sources, and thus the constructed tenon joint type space lattice structure is formed as a gravity structure, and heavy filling-materials such as soils and stones are filled into the hollow portion of the structure, and the gravitational force produced by the heavy filling material is also one of the structural resistance sources that can form a gravity structure as well. The combining pillar is piled into a stratum or a base, so that the combining pillar forms a cantilever support, which is also one of the resistance sources to the structure and makes the structure as a cantilever structure.

Further, the lattice unit of the light component is made of a light and high-strength material such as a polymer (resin), a metal base, an inorganic non-metal base composite, or an industrial plastic material, and both light component and heavy component require to have a hollow portion at the position of the tenon for passing through the combining pillar, and the lattices of the light component and the lattices of the heavy component may or may not have a hollow portion with the same factors of consideration, but the manufacture of the lattice unit of the heavy component does not require special processes, and general manpower can be used for the manufacture. The manufacture of the lattice unit of the light component not just requires special processes only, but also needs dedicated machines, since such lattice unit cannot be manually made easily. With these factors, lattices of the lattice unit of the light component preferably construct a hollow portion. The lattice unit of the light component in a construction can be transported and assembled by manpower due to the light weight of the lattice unit. Except special requirements, it is not necessary to employ additional hoisting machines, and the flexibility of adjusting the lattice units of the heavy component is much higher. In the meantime, a construction precision on the plane and height of the structure higher than those of the lattice units of the heavy component can be achieved. In the structure, the mass of the lattice unit of the light component produces a gravitational force which is insufficient to be one of the structural resistance sources, and the constructed tenon joint type space lattice structure is a light structure, and one of the structural resistance sources is a heavy filling material of a hollow portion of the structure, and the gravitational force produced by the heavy filling material is provided for forming a gravity structure. In addition, the combining pillar is piled into a stratum or a base, and the combining pillar constitutes a cantilever support which is another source of the structural resistance for forming a cantilever structure.

In structural dynamics, the methods of transmitting forces between the components of a tenon joint type space lattice structure and a general space lattice structure are different, primarily residing on that the source of an external force and a support method of a structure. The external force of a space lattice structure is generally the weight of the structure, the equipment and people carried by the structure, and the wind force, and the force is centralized for a support such as a pillar or a wall, and then transmitted into the stratum or base, and finally transmitted from the base to the stratum. In addition to the weight of the structure, the external forces of the tenon joint type space lattice structure are primarily earth pressure, water impact force, and water tractive force. For such external forces, the structure produces the gravitational force by the weights of the structure itself and the heavy filling material, and the friction produced by the gravitational force uses a distributed support method to resist the external forces. After an external force is exerted onto each combining pillar, the external force is transmitted directly into the stratum or base by the cantilever support of the combining pillar. In other words, a distributed method is provided for resisting external forces, and such method can be used separately or used for the whole structure.

Several issues on the construction and structure will be described as follows. A shift is usually occurred between plane layers of each structure of the construction, which makes the construction of the combining pillar very difficult, and may even cause a different dynamic mode of each structural layer. To prevent the occurrence of such problem, a combining pillar is built at a lower layer of the construction, and the combining pillar serves as a construction base for each plane layer along the direction of the height of the structure. Further, the lattice of the lattice unit does not come with a hollow portion, but is built on the lattices at the upper and lower layers of the lattice unit and corresponding to the convex tenon and the concave tenon groove, and the protruded tenon is embedded into the corresponding tenon groove in the tenon joint assembly, such that the lattices at upper and lower layers of the lattice unit so as to prevent the shift between layers. Further, the installation of accessory facilities is a feasible solution to achieve the same purpose. The lattices of the lattice unit are installed in the hollow portion, and a specific quantity of accessory short pillars is used as a base for the assembling of the upper and lower layers of the structure along the direction of the height of the structure to prevent the occurrence of a shift between layers. The invention can complete constructing a tenon joint type space lattice structure quickly and successfully, and soils and stones can be filled into the hollow portion of the structure for a large scale of vegetation. It is necessary to be aware of the strength of the tenon joint of the structure. If we want to enhance the tenon joint position, a rigid or flexible ring can be used for sheathing and connecting the combining pillar, and thus not only improving the strength of the tenon joint, but also enhancing the overall structural strength. The lattice unit of the light component can be converted to a heavy component by filling a heavy filling material such as concrete into a light component in the hollow portion of the lattice to seal the bottom of the lattice. For the structure having no hollow portion, a small hole can be made on the lattice for injecting a heavy filling material such as cement or sand pulp to achieve the same purpose. Further, heavy and light components of the hollow portion can be built on the lattice, and a straight or slanting reinforced partition can be installed at the hollow portion to enhance the structural strength of the components as well as the overall strength of the structure.

In summation, the tenon joint type space lattice structure of the invention is not just used for many civil engineering jobs such as the application for retaining walls, dams, water passages and walls only, but is also multifunctional in different areas as list below.

1. The construction is simple and quick due to the way of constructing the tenon joint assembly. Such advantage is obviously found in the lattice unit of the light component.
2. In general, a foundation is not built, and thus water can flow directly into the stratum to achieve the water preservation effect without the need of installing additional water drainage facilities.
3. The invention can stand a large subsidence due to the filling material in the hollow portion of the structure. The structure can sink by its own weight to produce a supplementary effect, and certain combination pillars can be used as a guide rod for the subsidence together with the lattice unit, without affecting the safety and stability of the structure.
4. The structure simply needs a simple arrangement at the position of installing the lattice unit depending on the terrain and geographic conditions, without the need of digging the whole ground for the construction.
5. The structure will not result in the highest overall damage, since each lattice unit is a separate substructure of the whole structure.
6. The hollow portion of the lattice unit structure is provided for a large scale of earth fill vegetation which is beneficial to our environmental maintenance and ecological environment.
7. The flexibility of building the lattice units allows us to create an excellent space and landscape with a plant arrangement.
8. The tenon joint type space lattice structure provides a multilevel protection effect, such that if a certain row is damage, the integrity of the whole structure will not be affected.

Therefore, the tenon joint type space lattice structure of the invention have a multiple of functions and features of the structure, such as providing a quick and simple construction, preserving water preservation, reducing the use of accessory facilities, standing a heavy subsidence, performing earth fill vegetation and creating landscape, etc.

DETAILED DESCRIPTION OF THE PREFERRED EMBODIMENT

To make it easier for our examiner to understand the objective of the invention, its structure, innovative features, and performance, we use the following preferred embodiments together with the attached drawings for the detailed description of the invention.

Figure 1:
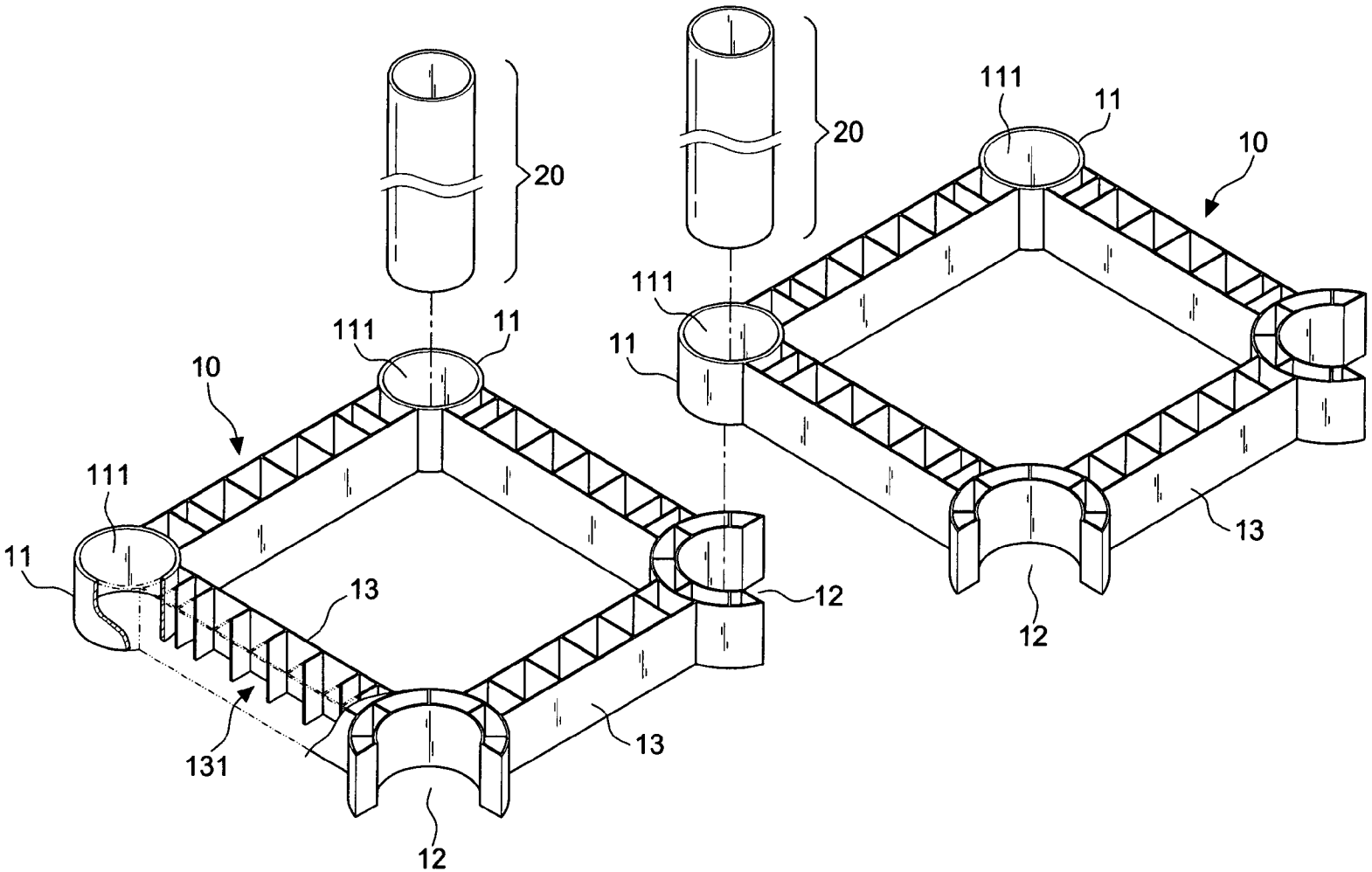
FIG. 1 is an exploded view of a structure in accordance with a first preferred embodiment of the present invention.
Figure 2:
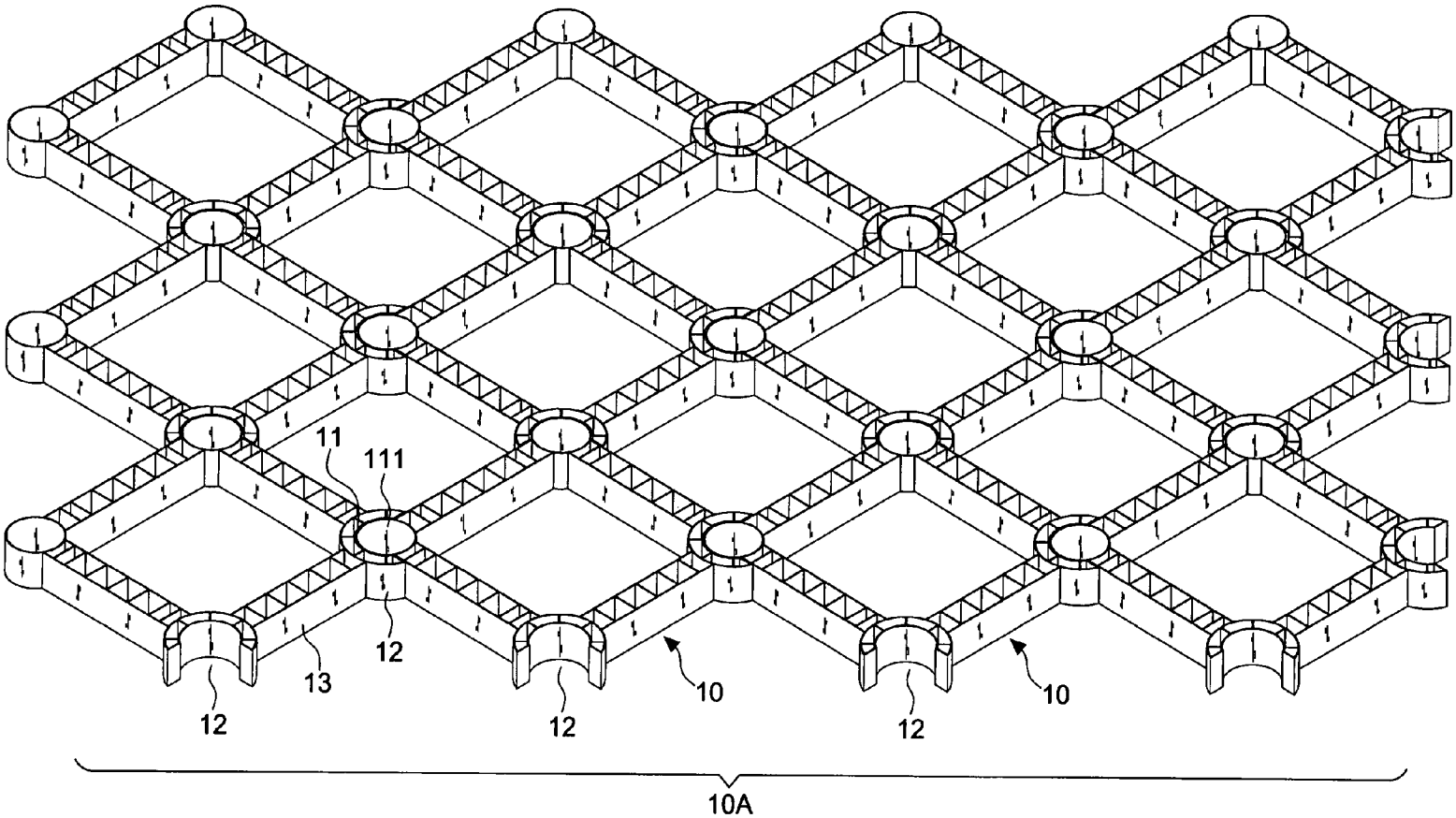
FIG. 2 is a schematic view of a plane layer structure in accordance with a first preferred embodiment of the present invention.
Figure 3:
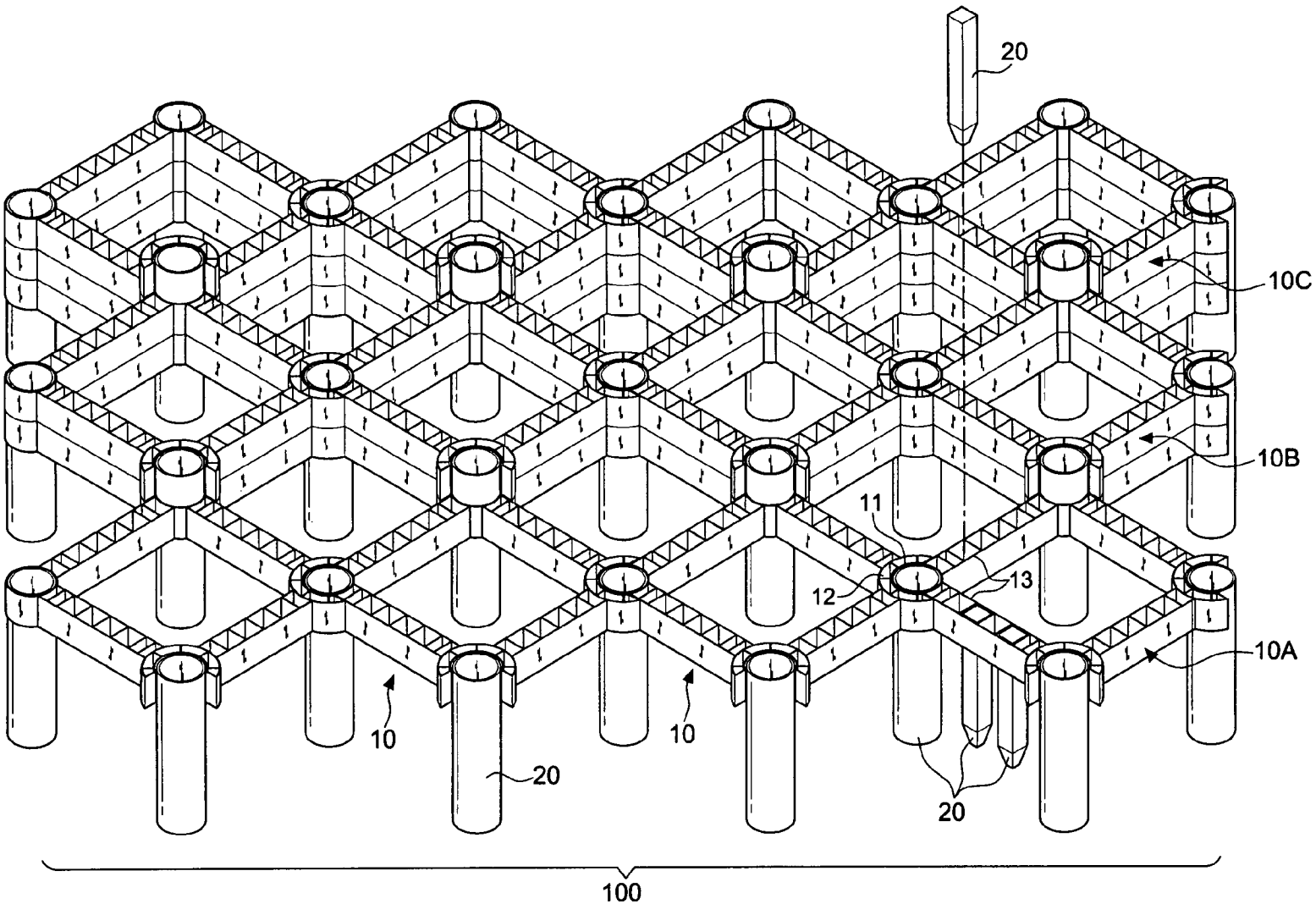
FIG. 3 is a perspective view of a space lattice structure in accordance with a first preferred embodiment of the present invention.

Referring to FIGS. 1 to 3 for a first preferred embodiment of the present invention, the invention comprises a predetermined quantity of lattice unit 10 and a specific quantity of combining pillars 20.

The lattice unit 10 is preferably a module made of a light and high-strength resin matrix composite material, but not limited to such material only, and a metal base, an inorganic non-metal composite material and a plastic material may be used to make the lattice unit of the light hollow component. Each side or edge has two or more convex and concave tenons 11 and tenon grooves 12, and the tenons 11 and the tenon grooves 12 are corresponding tenon-and-groove structures, and the tenon 11 protruded between the lattice units 10 of the light hollow component can be embedded into the corresponding tenon groove 12 for connecting with each other by a tenon joint assembling method, so as to construct a plane layer 10A of a predetermined frame structure.

In this preferred embodiment, the lattice unit 10 of the light hollow component comprises: a frame body with a plurality of hollow lattices 13 formed by erected and transversally and longitudinally interlaced sheet bodies on each frame edge; a hollow tenon 11 formed at an end on one of the sides of the lattice 13, such that the tenon 11 has a hollow portion 111; and a tenon groove 12 with an opening facing outward and disposed at an end of another corresponding lattice 13. In this embodiment, the tenon 11 is of the same height with the hollow cylindrical body of the lattice 13, and the tenon groove 12 is of the same height with C-shaped body of the lattice 13. The hollow lattice 13 as shown in FIG. 1 is a body with a hollow 131 at its bottom.

Figure 4:
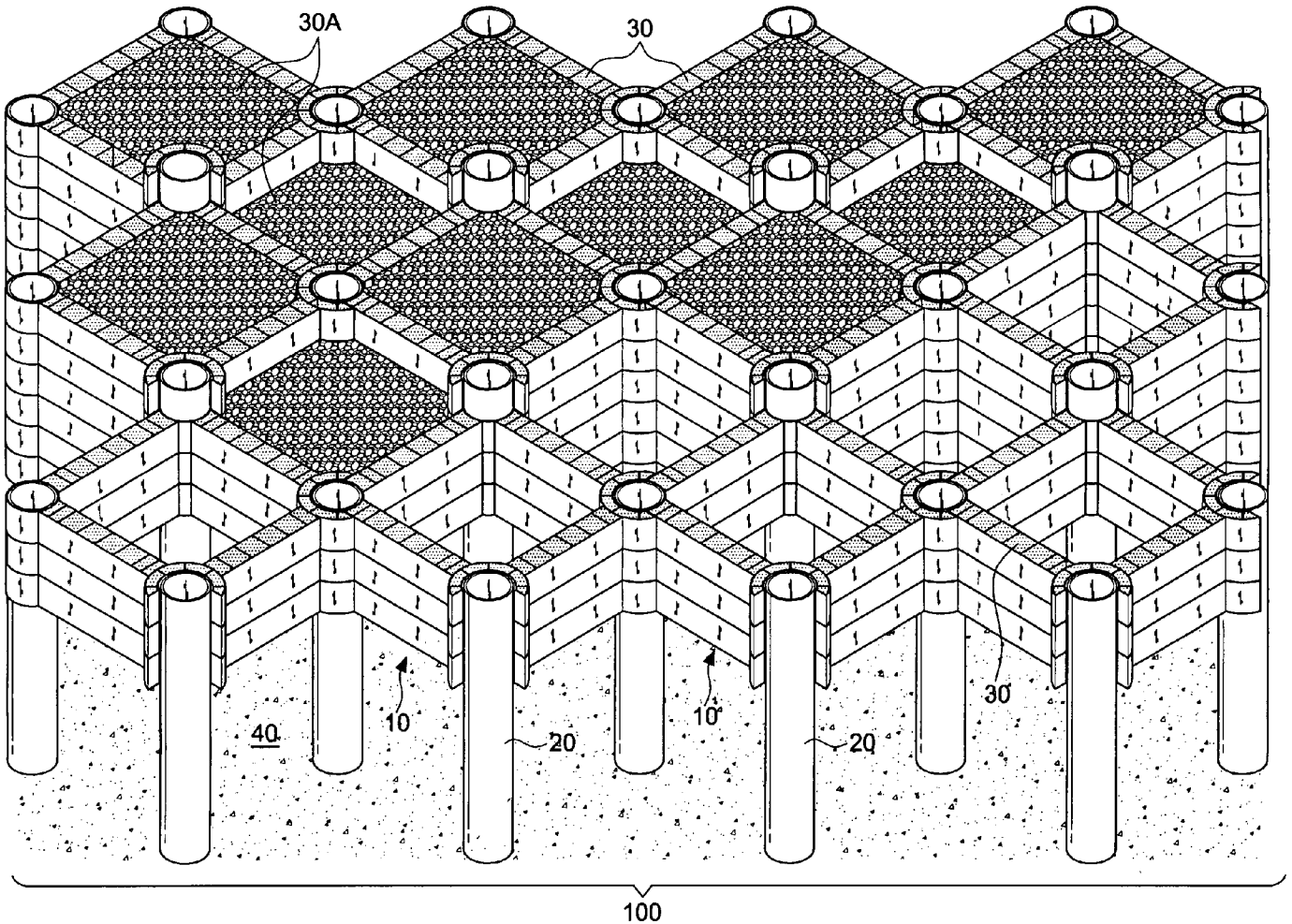
FIG. 4 is a perspective view of a space lattice structure used for forming gravity and cantilever structures in accordance with a first preferred embodiment of the present invention.

The combining pillar 20 comprises a hollow or solid pillar made of the same material such as steel concrete, steel and light hollow component, and the combining pillar 20 is provided for passing through a hollow portion of the lattice unit 10 of the light hollow component, and the hollow portion includes a hollow body in the lattice 13, but preferably the aforementioned hollow tenon 11 and hollow tenon groove 12, for connecting each plane layer 10A, 10B, 10C in series along the height and direction of the structure as shown in FIG. 3 to constitute a three-dimensional space lattice structure 100. In FIG. 4, the present invention can also fill a soil and stone filling material 30A into a hollow portion of the space lattice structure 100 in addition to filling a heavy filling material 30 into the hollow lattice 13 of the light lattice unit 10 to constitute a gravity structure, and a portion of the combining pillar 20 is piled into a stratum or a foundation 40 to form a cantilever structure.

Figure 5:
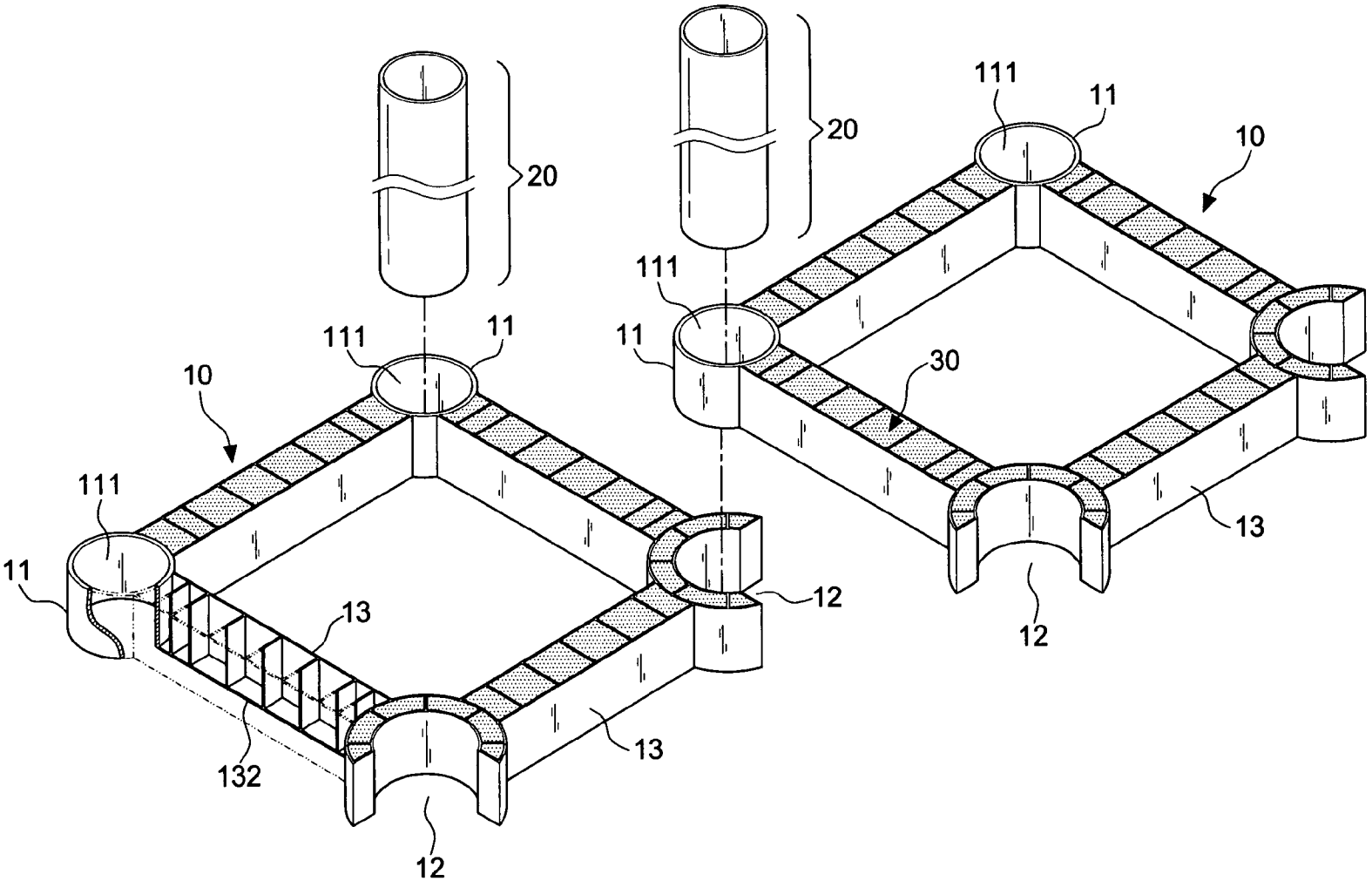
FIG. 5 is a schematic view of another structure of a lattice unit in accordance with a first preferred embodiment of the present invention.
Figure 6A:
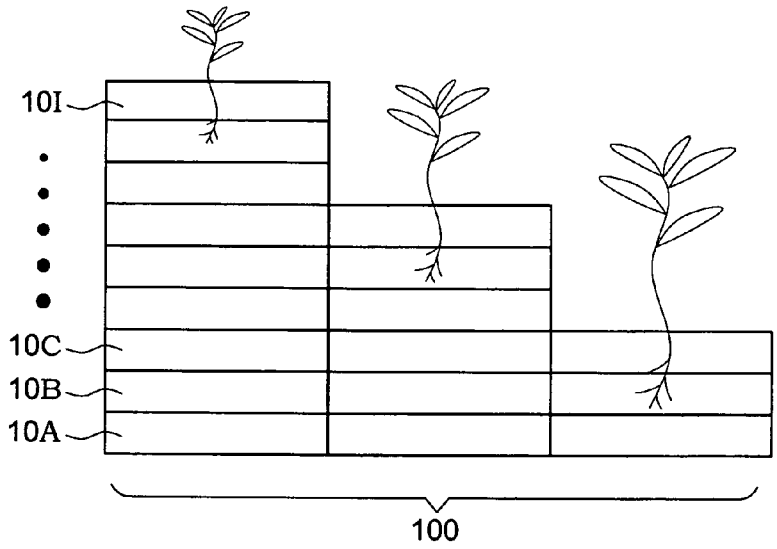
FIGS. 6A~6D are schematic views of an application of creating landscape by a retaining wall, a dam, a water drainage and an earth fill vegetation created by the aforementioned components in accordance with the present invention.
Figure 6B:
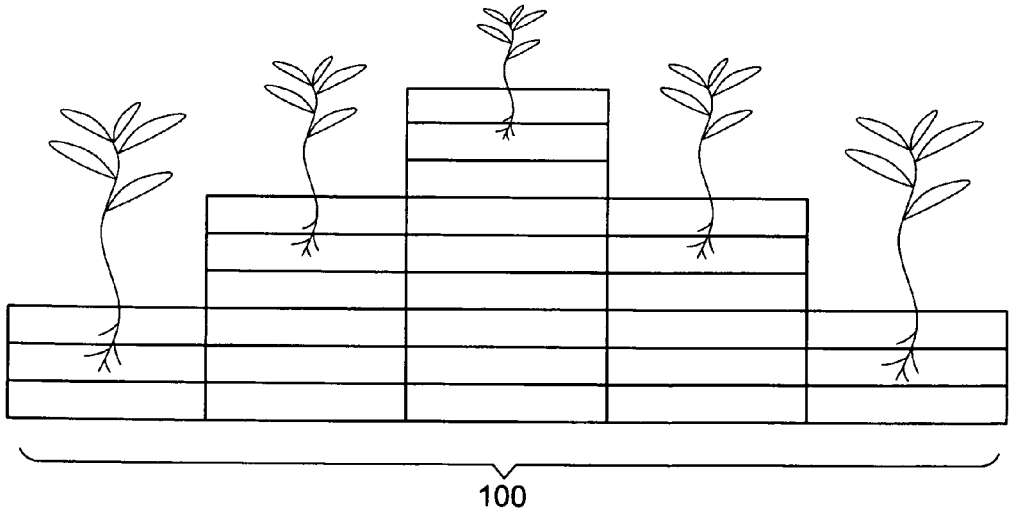
Figure 6C:
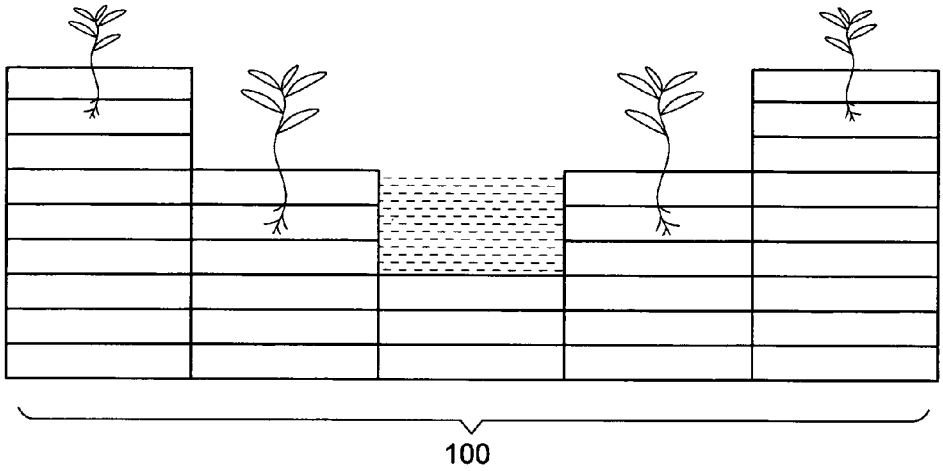
Figure 6D:
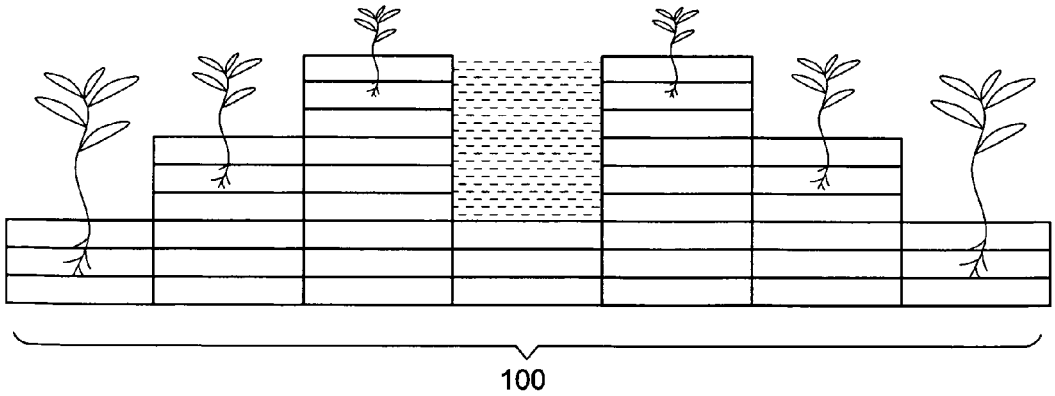

In FIG. 5, the light lattice unit 10 comprises a hollow lattice 13, and the bottom of any one of the hollow lattices 13 is in a sealed status 132, and the heavy filling material 30 is filled in the hollow lattice 13 to convert the component from a component of a light structure into a component of a gravity structure.

Referring to FIGS. 6A~6D for schematic views an application of the present invention, the invention adopts the foregoing technical measure to provide different functions including a simple and quick construction of a retaining wall, a dam, a water passage and a landscape according to the construction requirements, and also provides a good effect on the structure.

Figure 7:
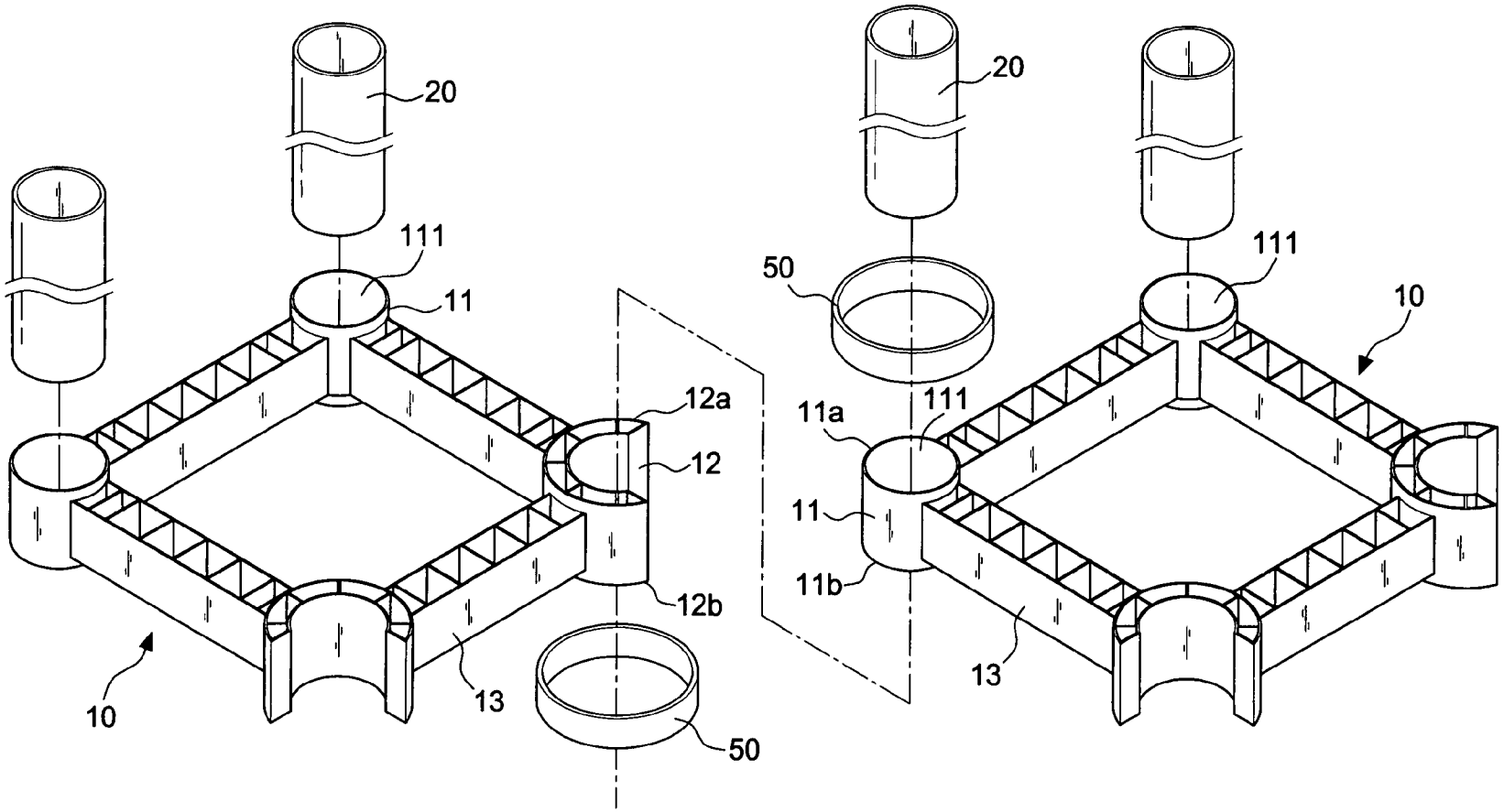
FIG. 7 is an exploded view of a structure in accordance with a second preferred embodiment of the present invention.
Figure 8:
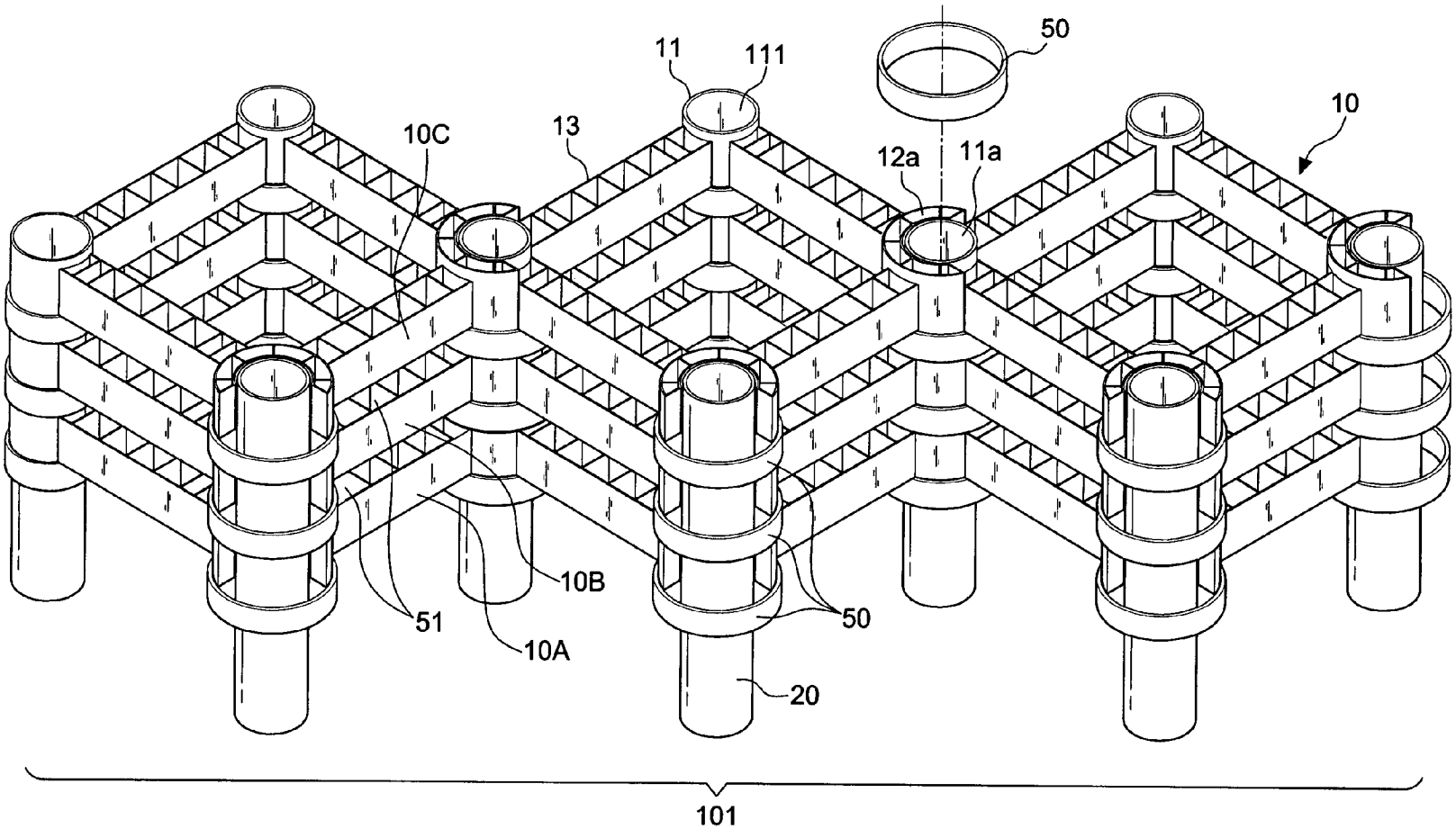
FIG. 8 is a perspective view of a space lattice structure in accordance with a second preferred embodiment of the present invention.

Referring to FIGS. 7 and 8 for a second preferred embodiment of the present invention, same numerals are used to represent same elements of the previous structure, and the difference of this structure from the previous structure resides on that both upper and lower ends of the tenon 11 are protruded from the lattice 13, and have a hollow cylindrical body of the upper and lower extended portions 11*a*, 11*b*. The tenon groove 12 includes upper and lower ends protruded from the lattice 13 and a C-shaped body having upper and lower extended portions 12*a*, 12*b*. Further, external periphery of upper and lower extended portions 12*a*, 12*b* of the tenon groove 12 includes a rigid or flexible ring 50 for sheathing and connecting the tenon joint assembling and the combining pillar 20 to form another type of space lattice structure 101, such that a gap 51 with a height equal to one ring 50 is formed between each plane layer 10A, 10B, 10C, which is beneficial to the structure for a certain special construction.

Figure 9:
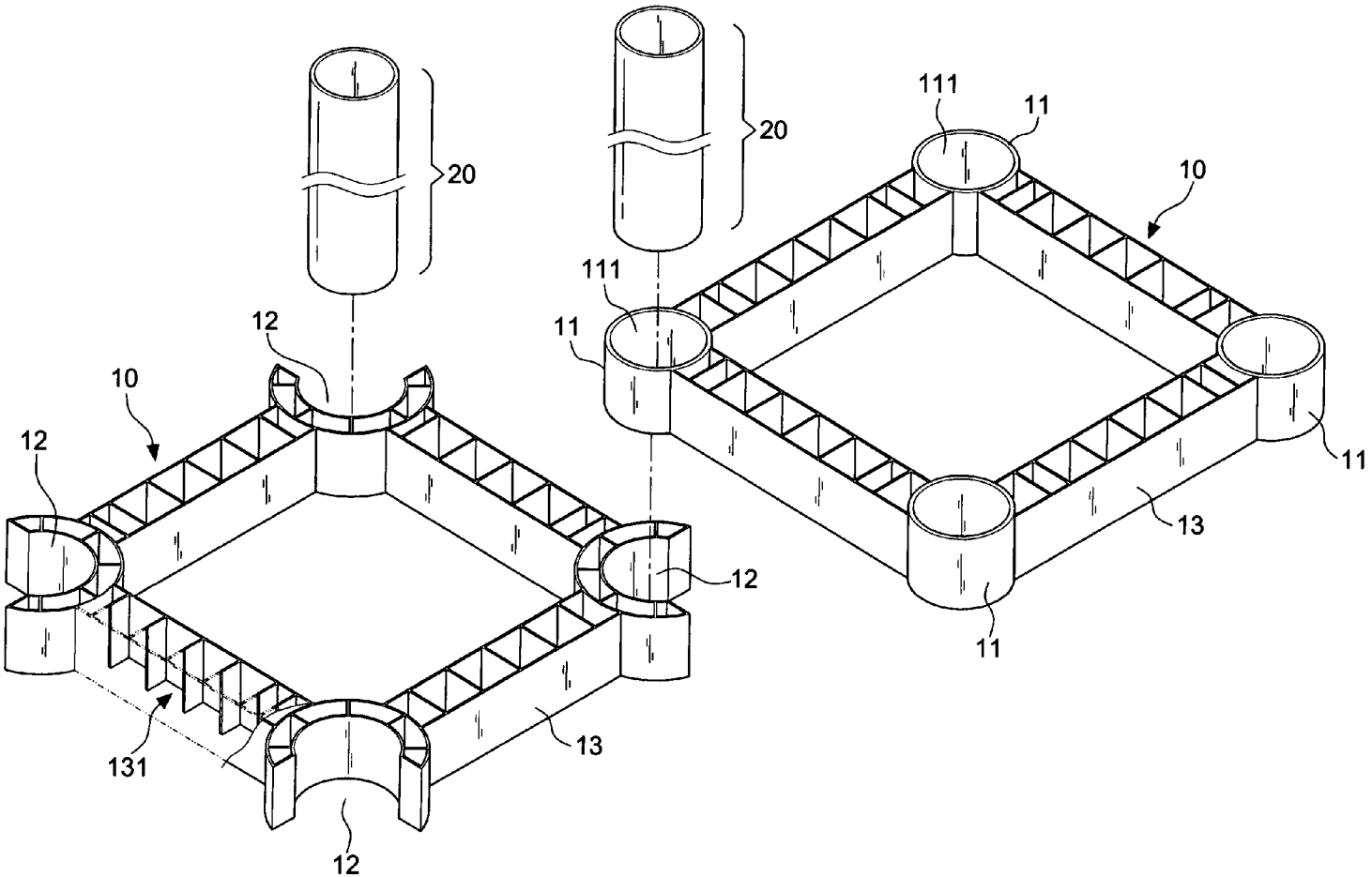
FIG. 9 is a perspective view of a lattice unit in accordance with a third preferred embodiment of the present invention.
Figure 10:
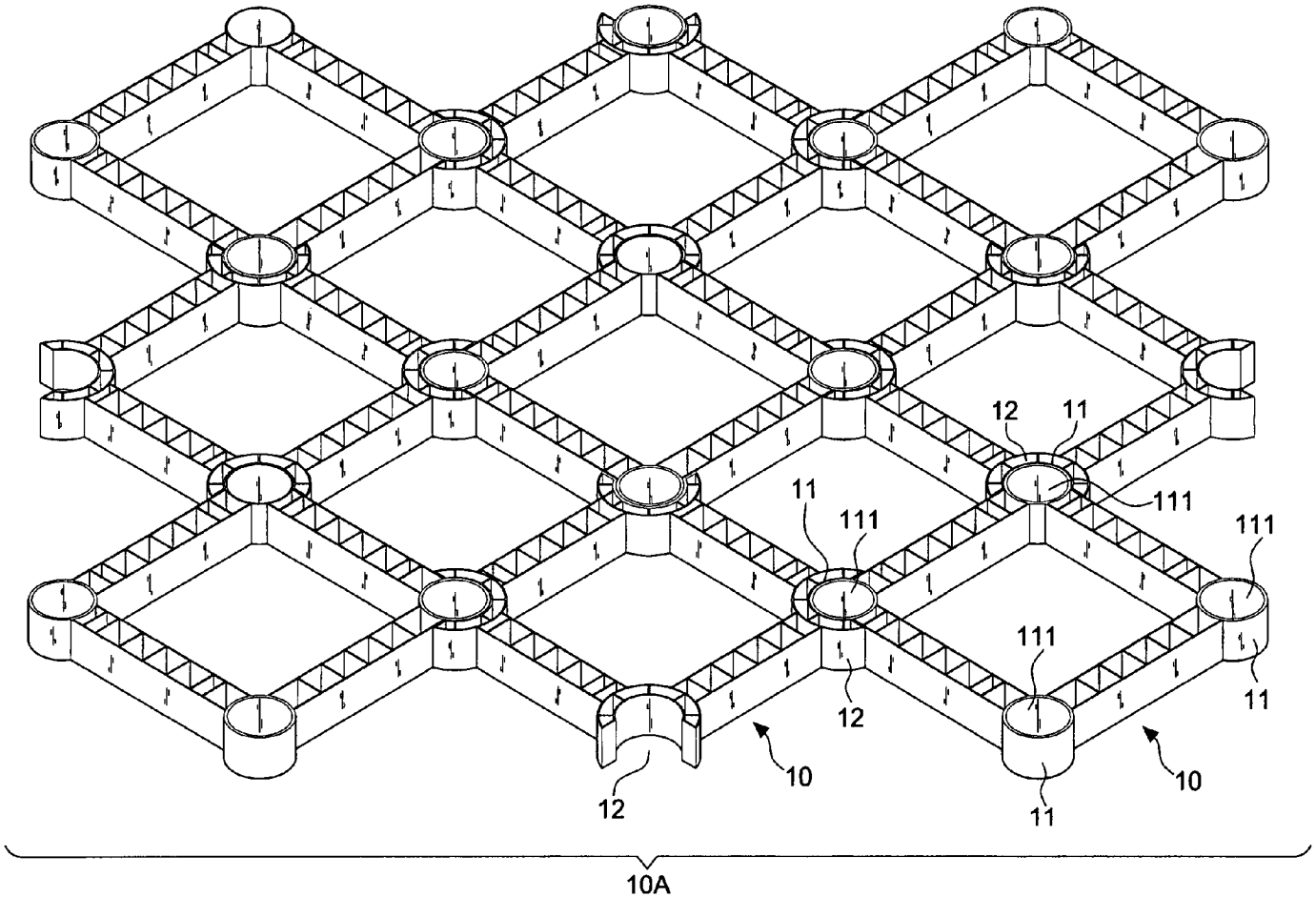
FIG. 10 is a perspective view of a plane layer in accordance with a third preferred embodiment of the present invention.

Referring to FIGS. 9 and 10 for a third preferred embodiment of the present invention, the same numerals are used to represent the same elements of the previous structure, and the difference of this structure from the previous structure one resides on that the lattice unit 10 of the previous structure includes two tenons 11 and two tenon grooves 12 disposed a same lattice unit 10. In this preferred embodiment, a hollow tenon 11 is formed at an end of the lattice 13, and a tenon groove 12 with its opening facing outward is formed at an end of an adjacent lattice 13 that is coupled to another frame body by a tenon joint assembling. Thus, two different types of lattice units 10 are connected alternately by a tenon joint method to produce a plane layer 10A as the previous embodiment.

Figure 11:
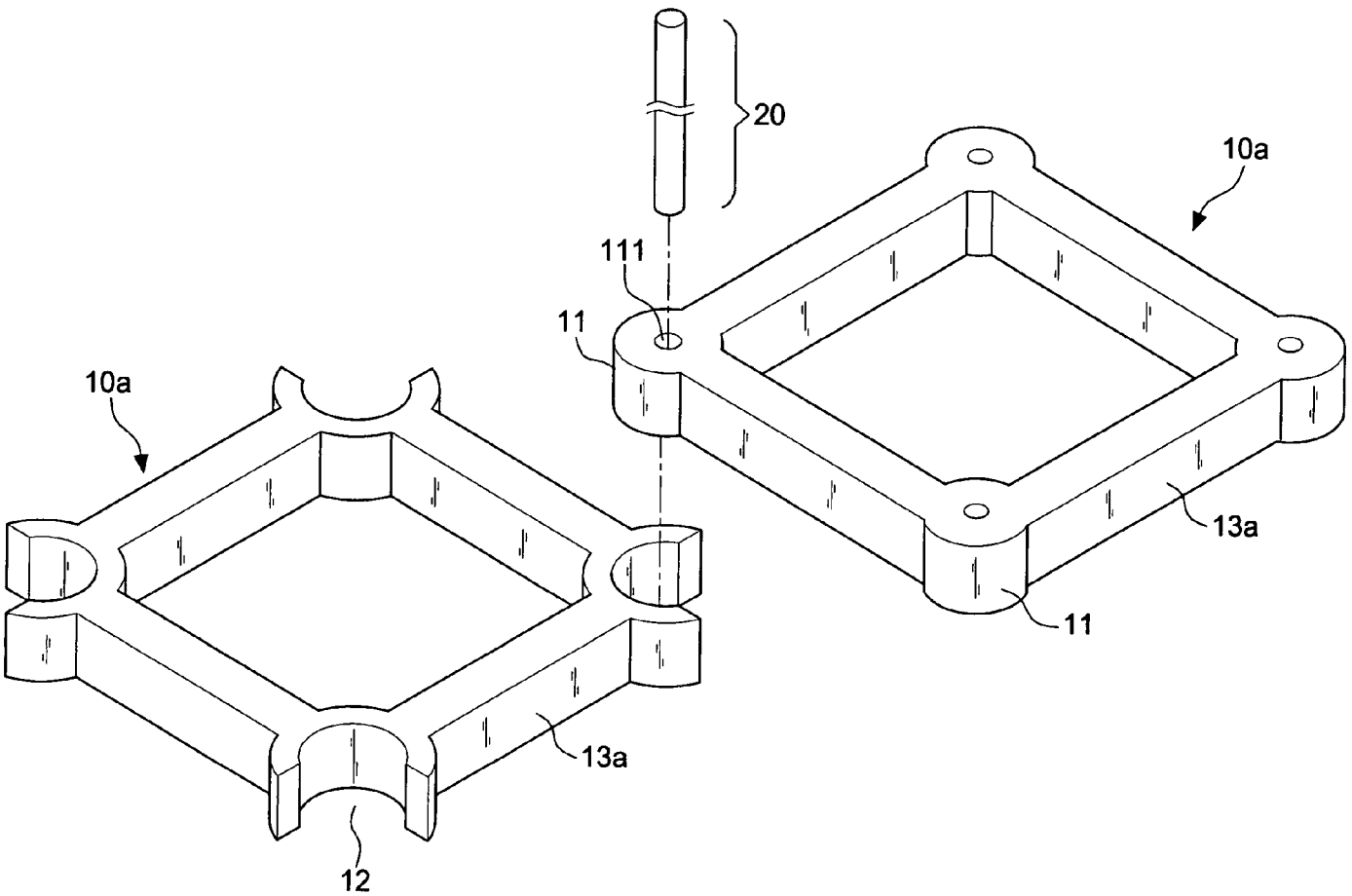
FIG. 11 is a perspective view of a lattice unit in accordance with a fourth preferred embodiment of the present invention.
Figure 12:
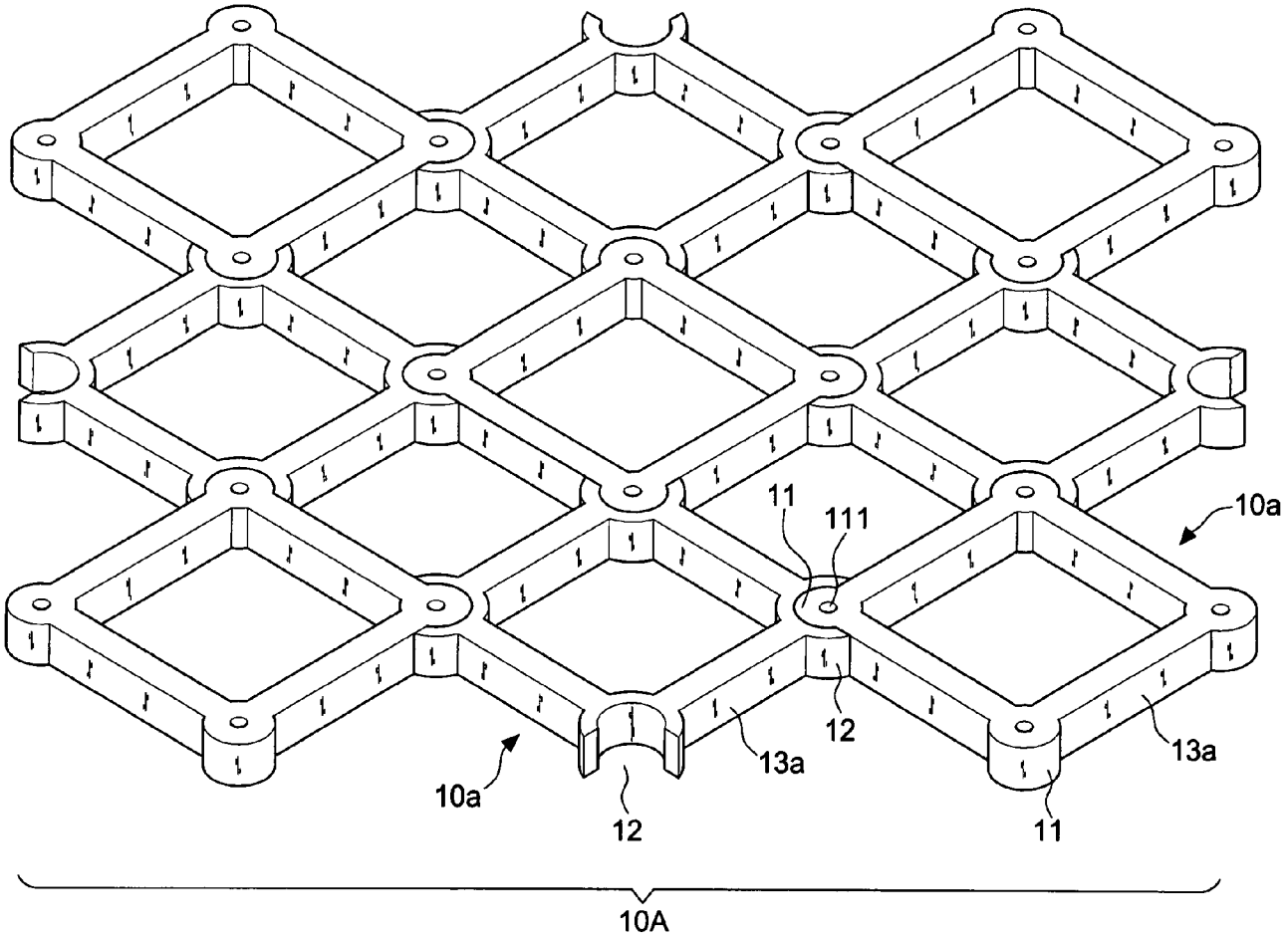
FIG. 12 is a perspective view of a plane layer in accordance with a fourth preferred embodiment of the present invention.
Figure 13:
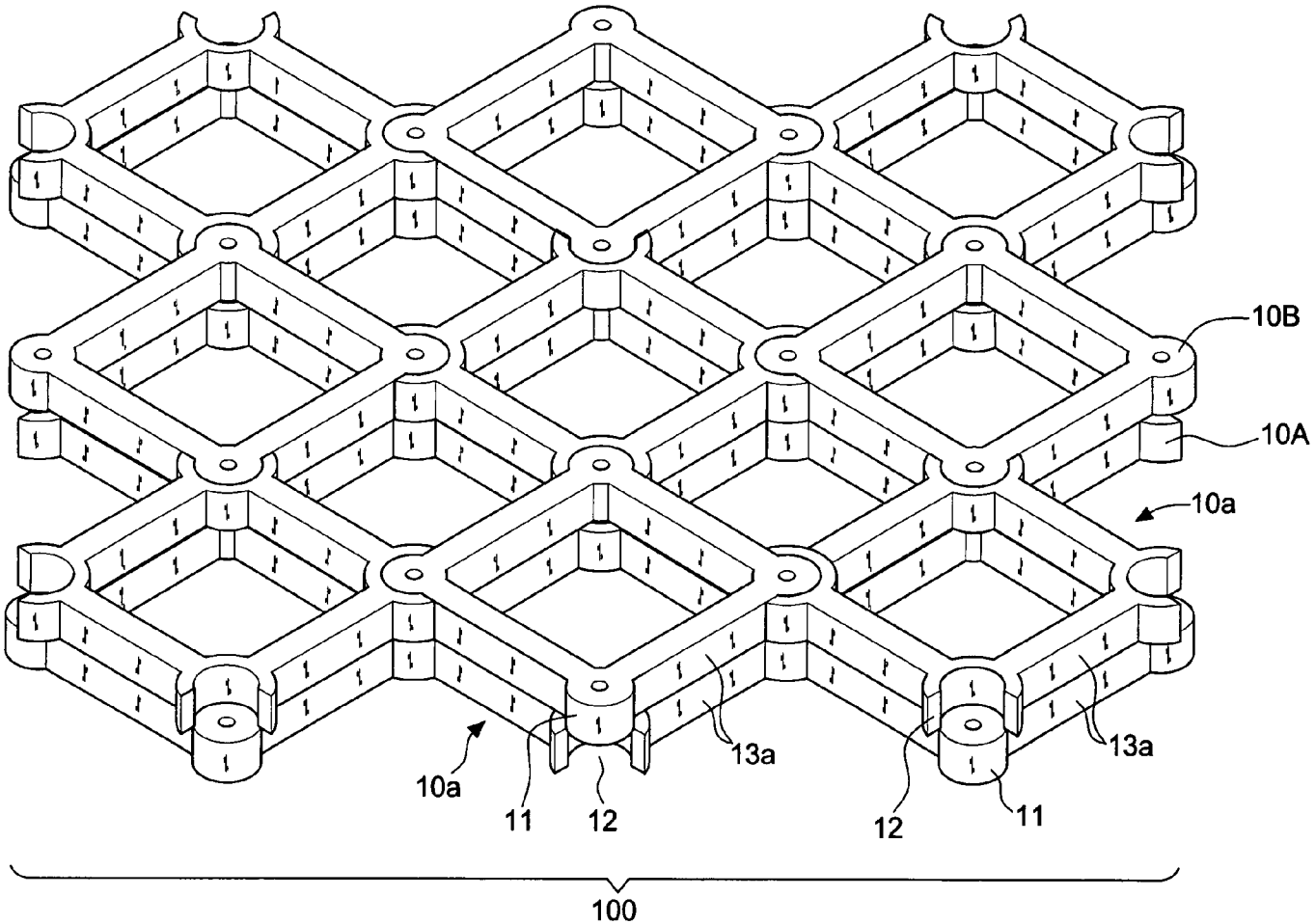
FIG. 13 is a perspective view of a space lattice structure in accordance with a fourth preferred embodiment of the present invention.

Referring to FIGS. 11 to 13 for a fourth preferred embodiment of the present invention, the same numerals are used to represent the same elements of the previous structure, and the difference of this structure from the previous structure one resides on that the lattice unit 10 is a heavy component made by a heavy material such as metal, steel concrete and wood, etc. In other words, the lattice 13*a*, tenon 11, and tenon groove 12 are heavy components. The tenon 11 also has a hollow portion 111 with a smaller through hole to go with a combining pillar 20 which is a solid cylindrical body. The tenon 11 and the tenon groove 12 of this embodiment are formed at an end of one of the lattice units 10; but not limited to such arrangement. Like the first preferred embodiment, a lattice unit 10 of this embodiment may have two tenons 11 and two tenon grooves 12 in the same time as shown in FIG. 1, and thus will not be described here. In addition, the first plane layer 10A installed by the lattice unit 10 as shown in FIG. 13, and the second plane layer 10B disposed thereon vertically corresponds to the first plane layer 10A, such that the tenon groove 12 is disposed at the top of the tenon 11, and then the lattice units 10 can be stacked alternately upward to facilitate the overall stability of the structure.

Figure 14:
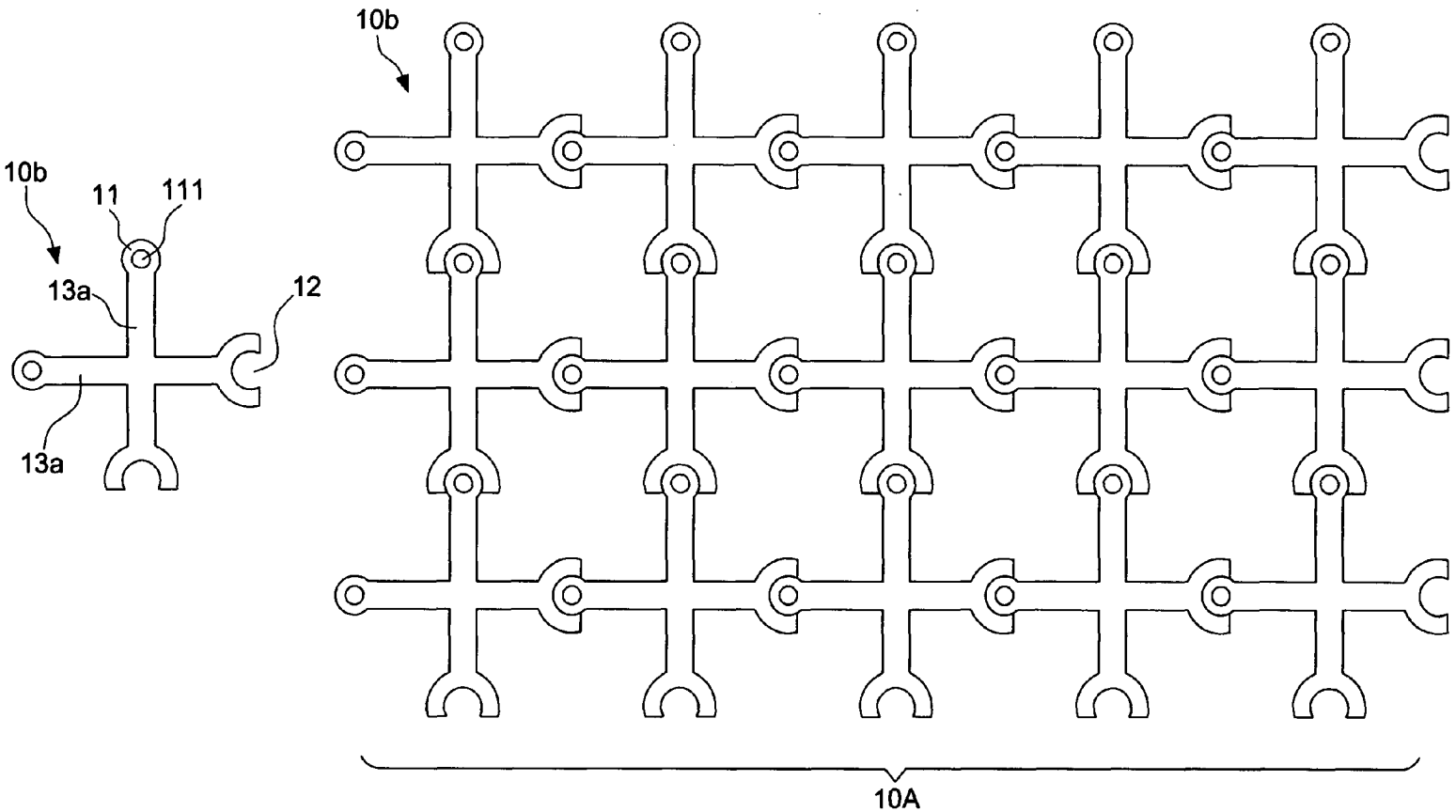
FIG. 14 is a top view of a lattice unit and a plane layer in accordance with a fifth preferred embodiment of the present invention.

Referring to FIG. 14 for a fifth preferred embodiment of the present invention, the lattices 13*a* of the lattice unit 10B are perpendicular with each other, and two tenons 11 with a hollow portion 111 and two corresponding tenon grooves 12 are disposed at an end of the tenon 11, and can be coupled to form a plane layer 10A by a tenon joint assembling process, and the characteristics and effects are the same as the aforementioned preferred embodiment.

Figure 15:
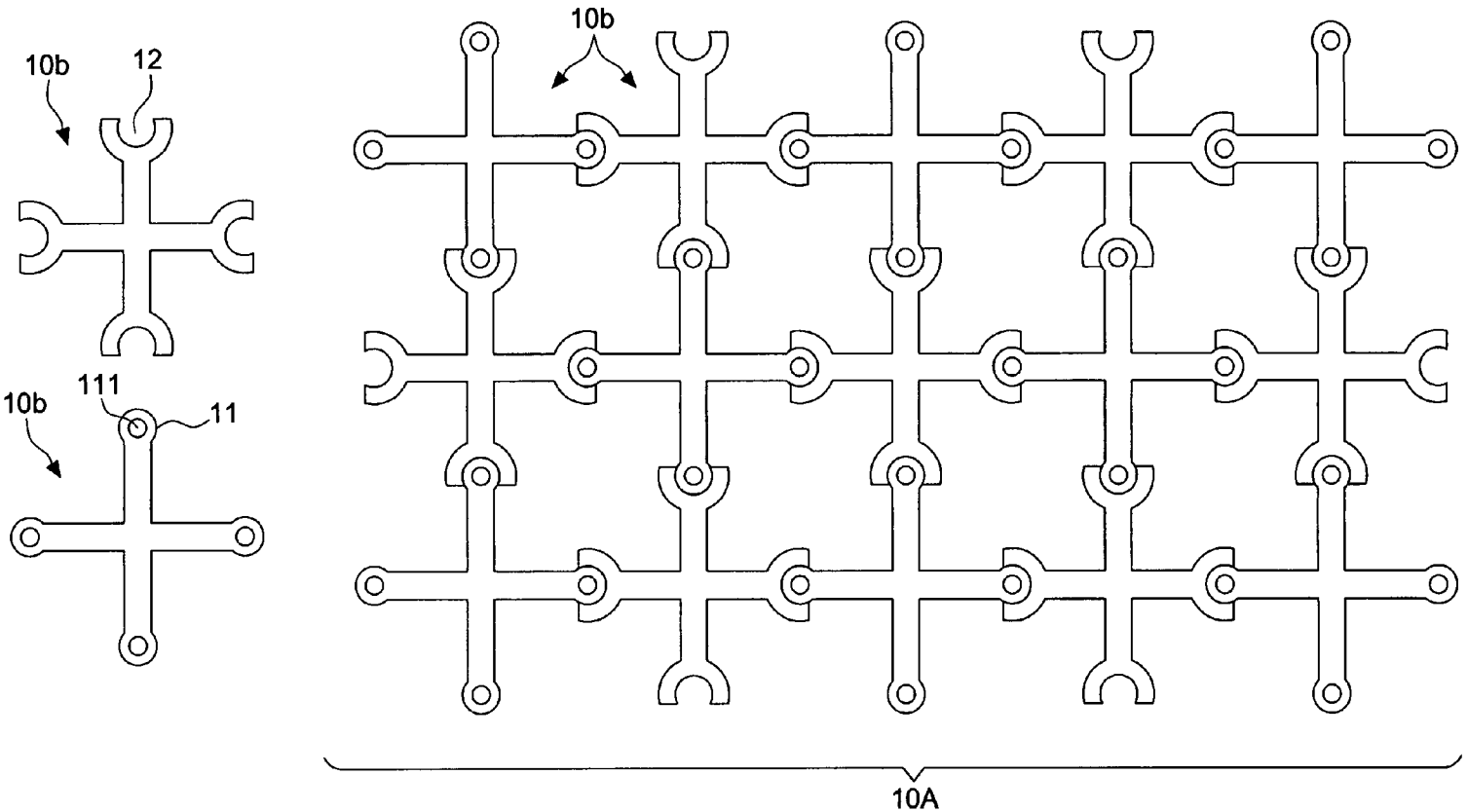
FIG. 15 is a top view of a lattice unit and a plane layer in accordance with a sixth preferred embodiment of the present invention.

Referring to FIG. 15 for a sixth preferred embodiment of the present invention, the difference of this embodiment with the previous embodiment resides on that a same lattice unit 10B can be a tenon 11 or a tenon groove 12 at the same time, and the plane layer 10A of its tenon joint assembling has the same effect.

Figure 16A:
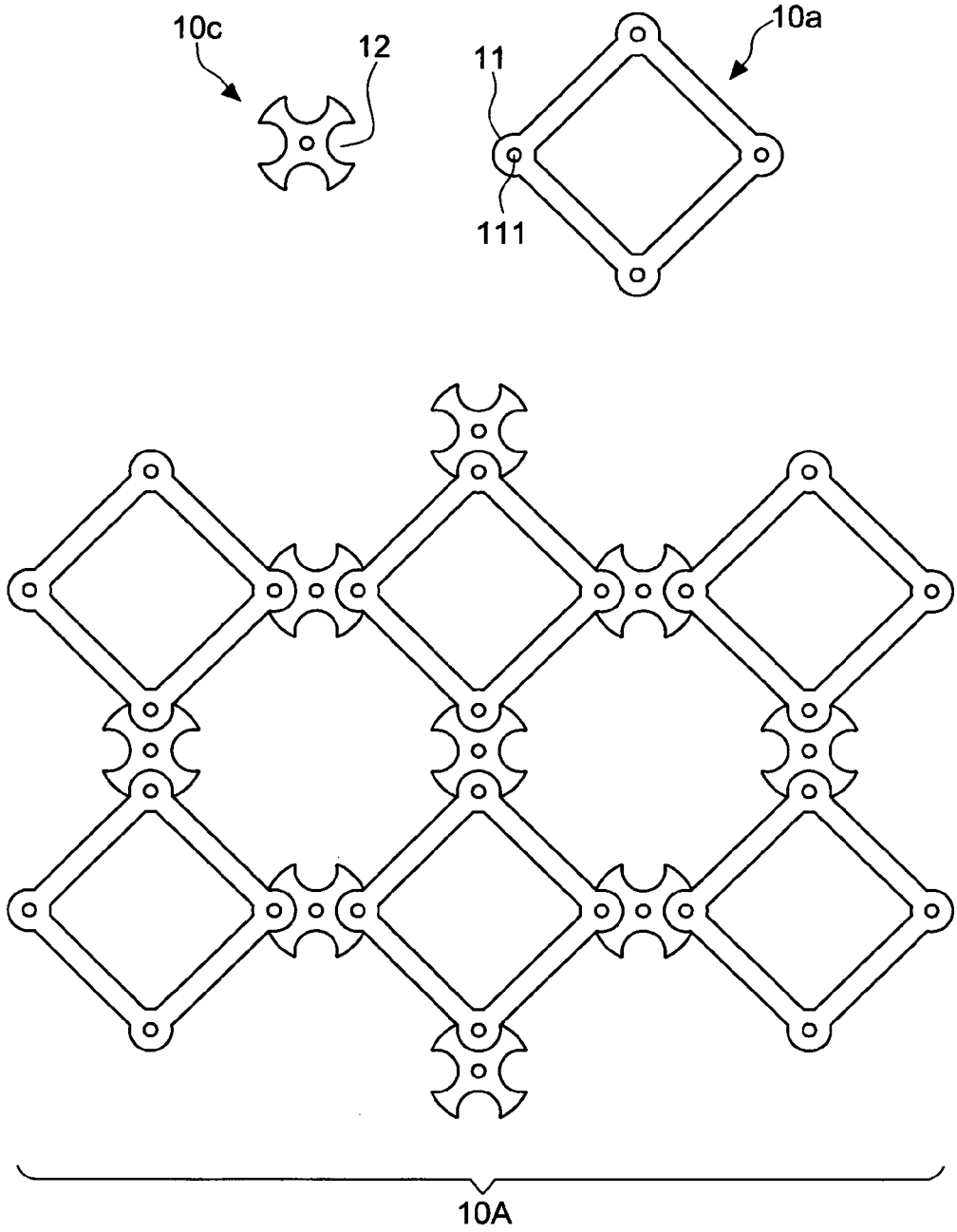
FIGS. 16A~16H are schematic view of a combination of lattice units in accordance with the present invention.
Figure 16B:
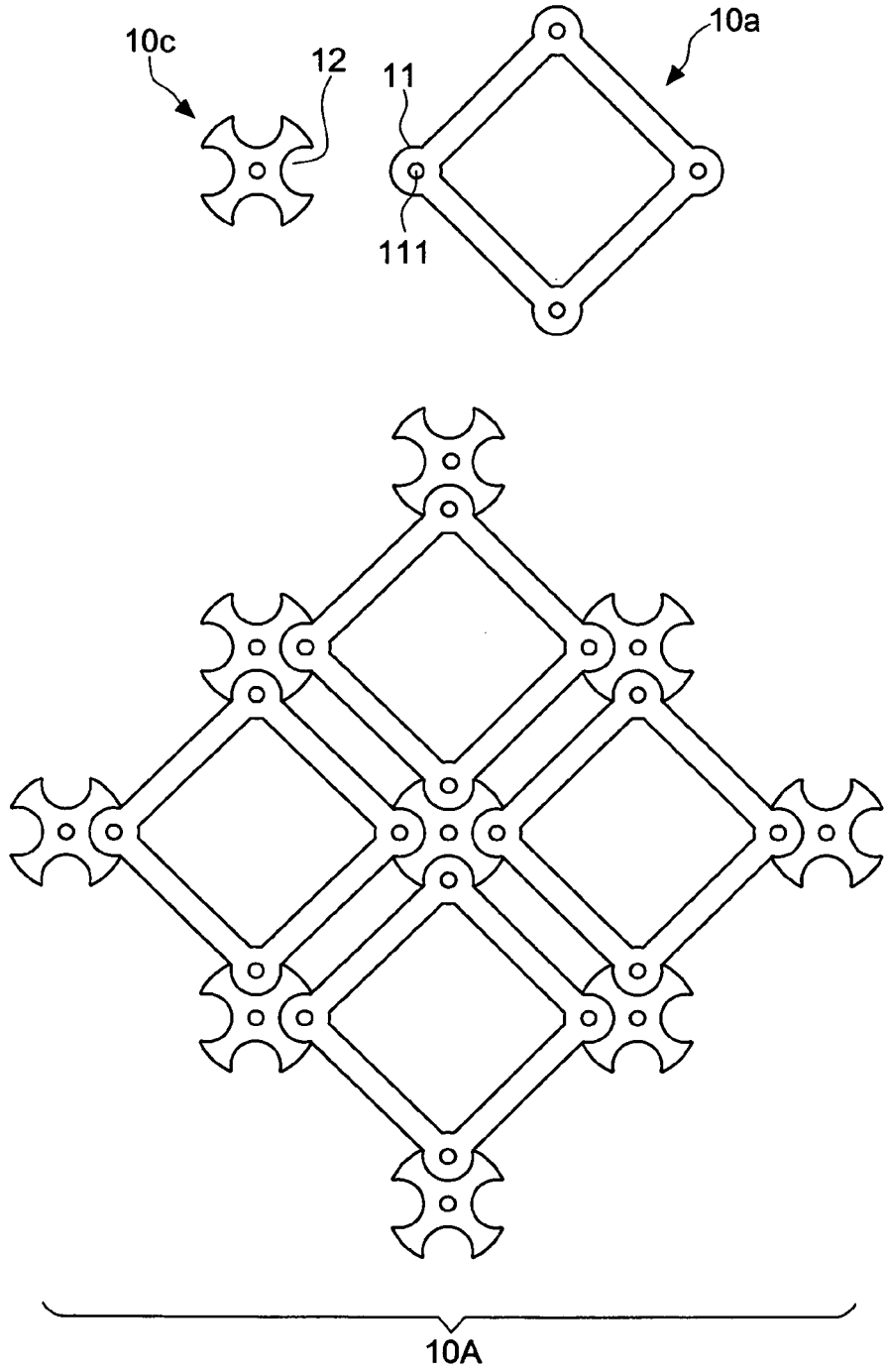
Figure 16C:
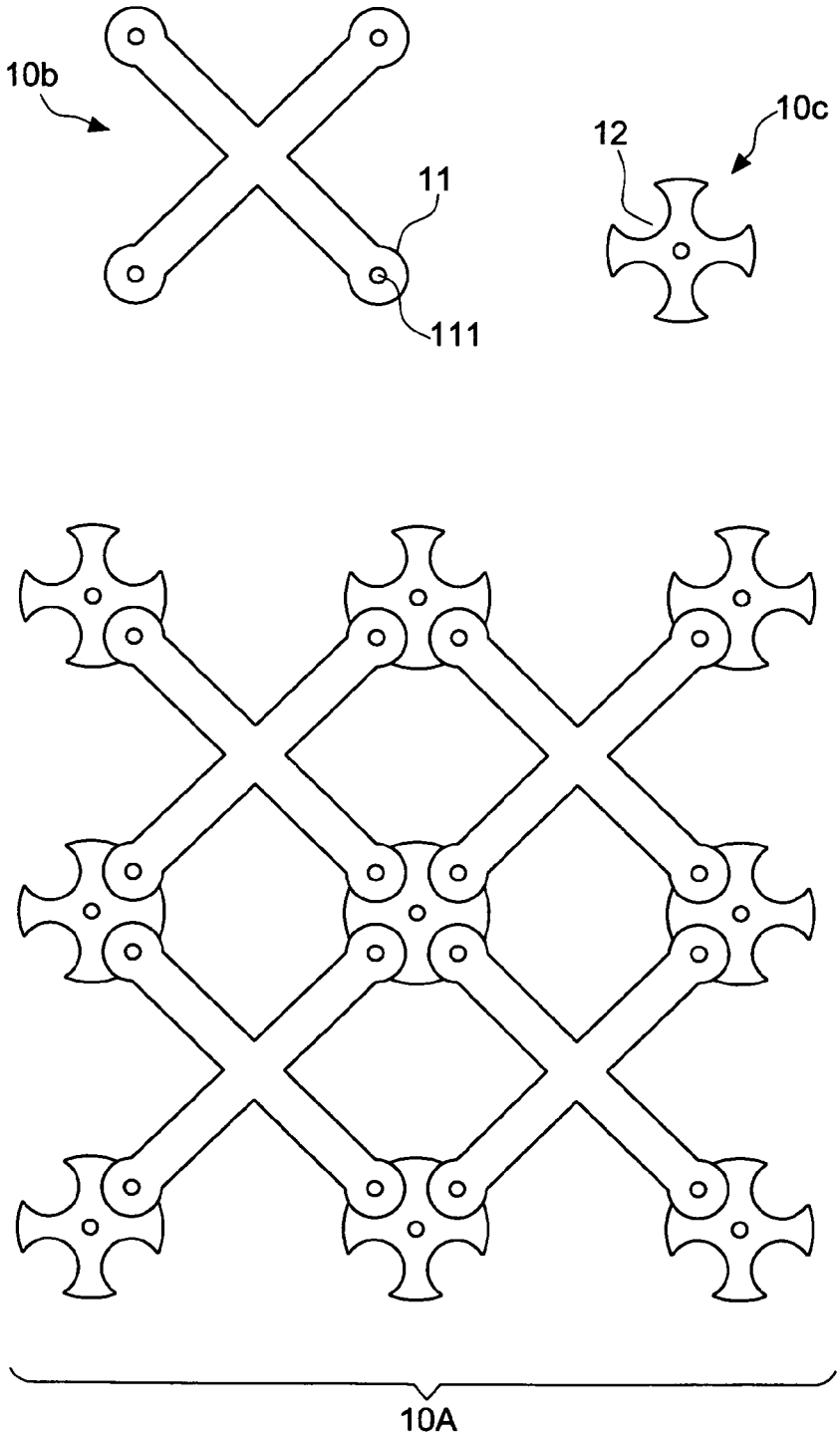
Figure 16D:
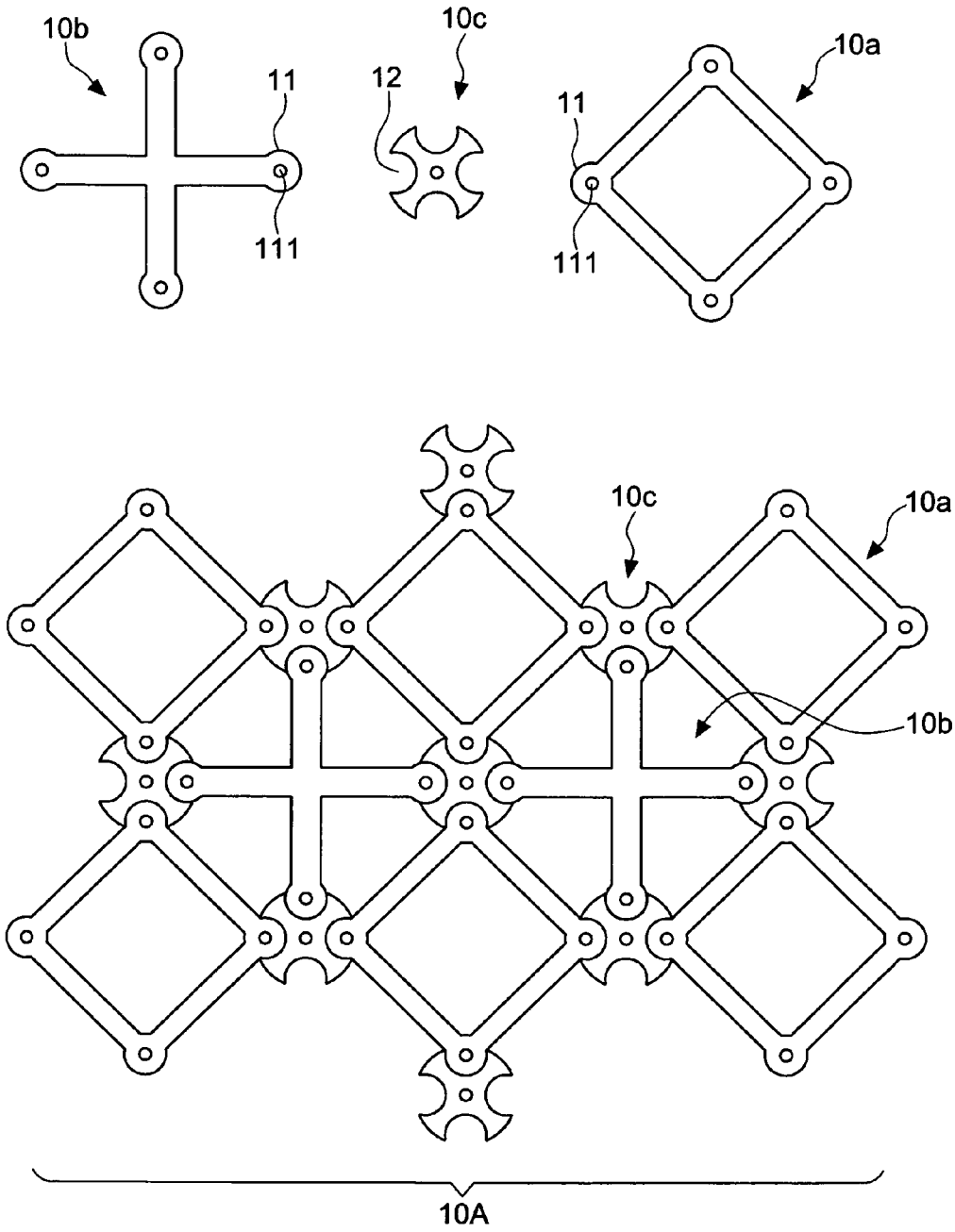
Figure 16E:
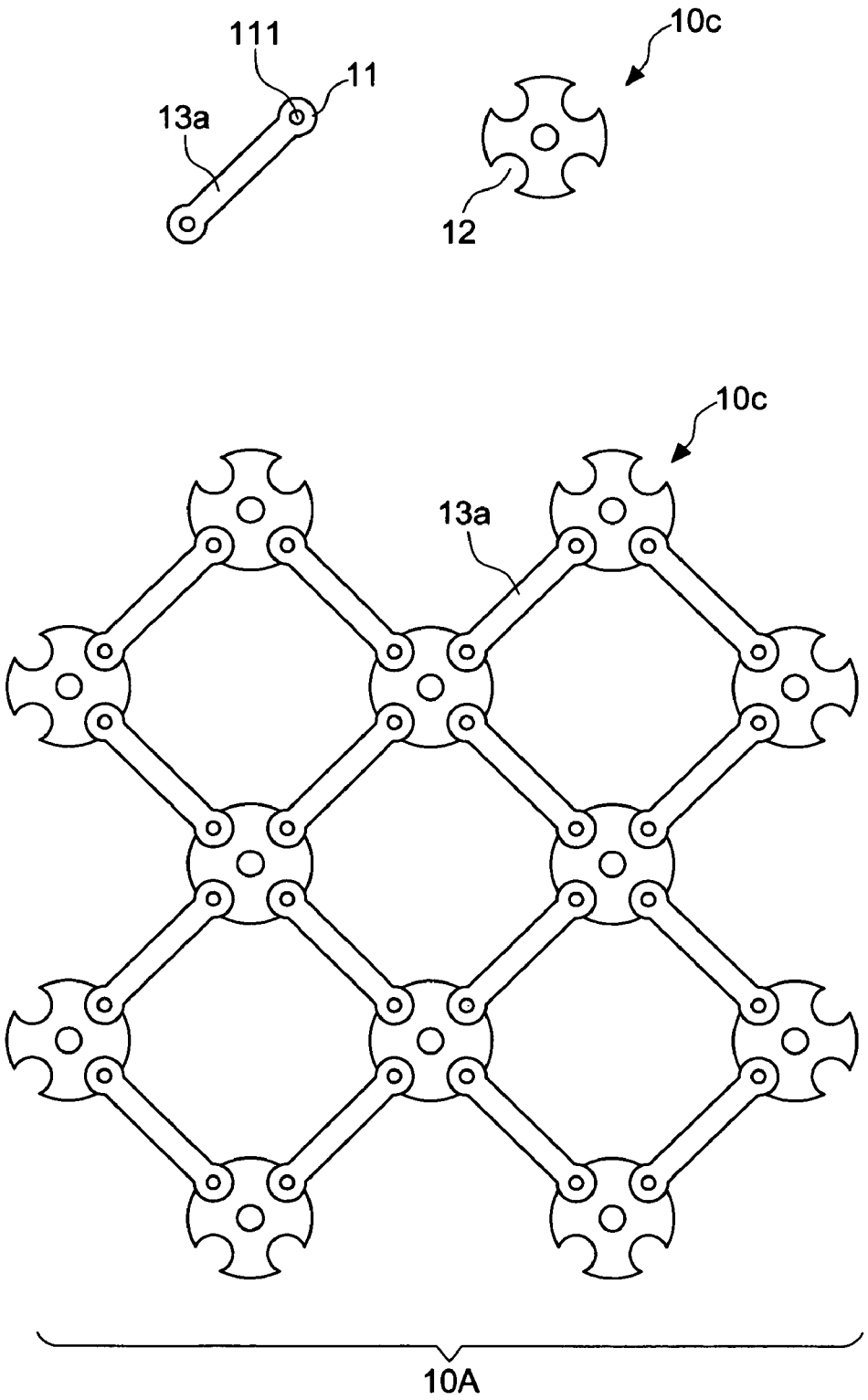
Figure 16F:
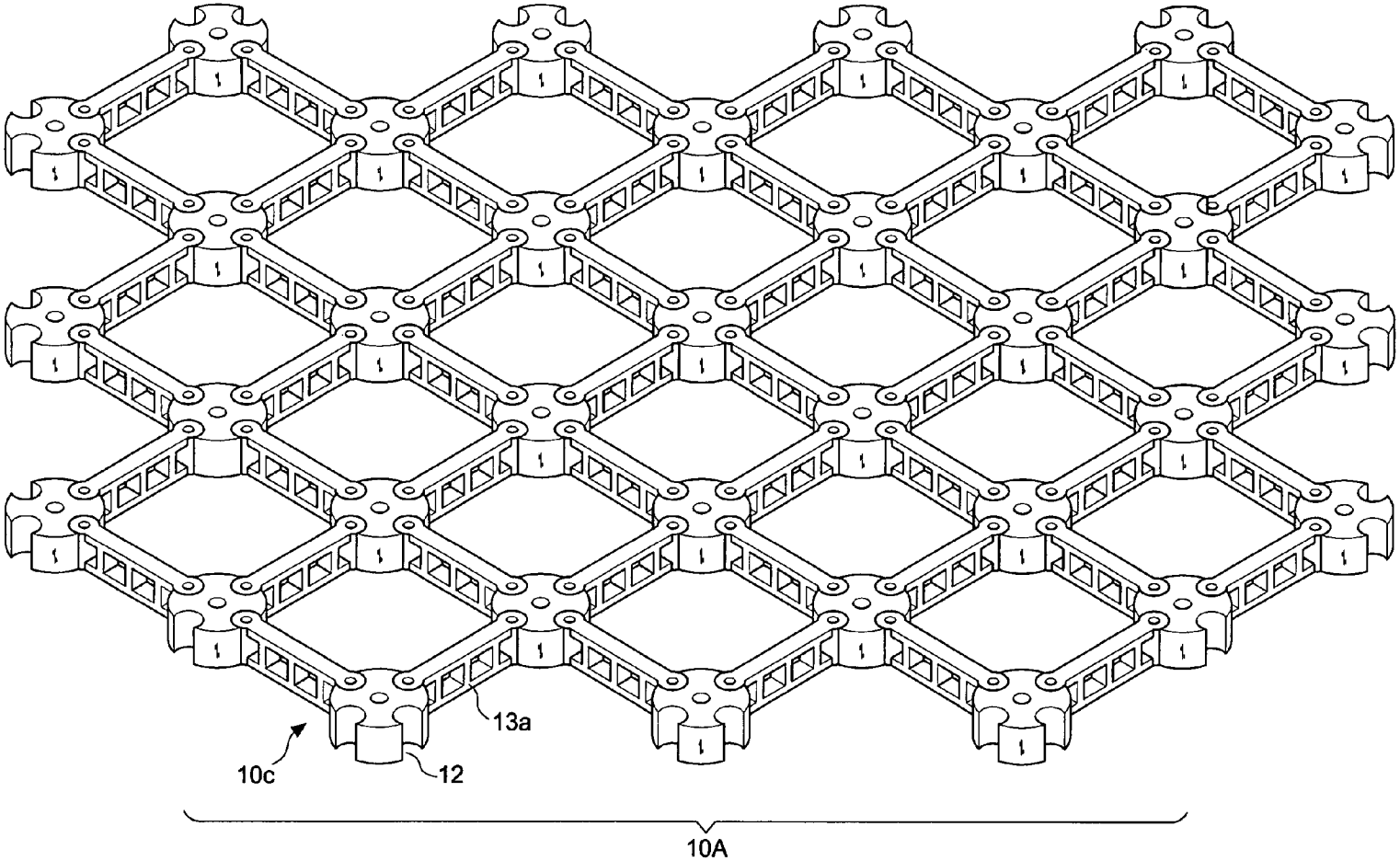
Figure 16G:
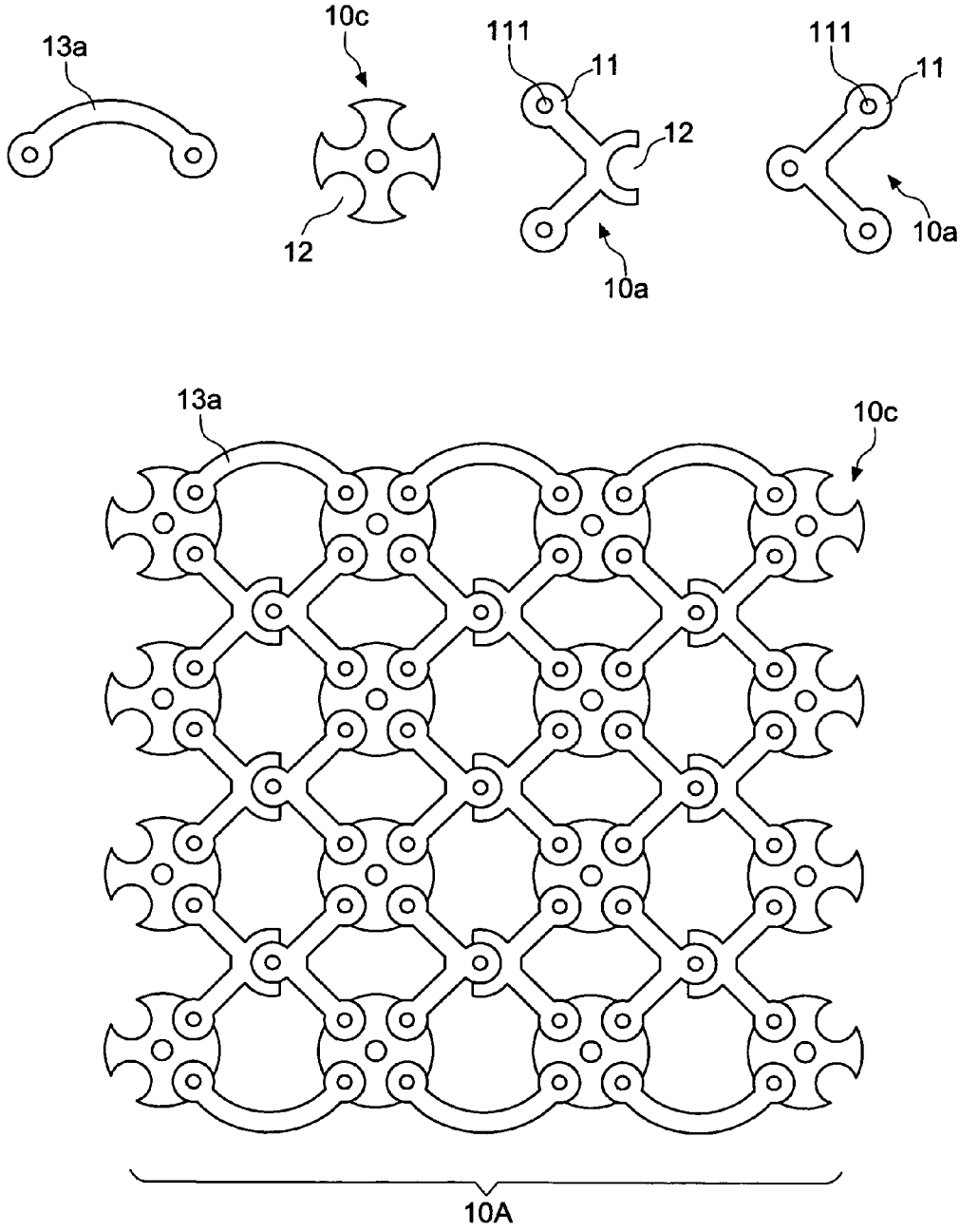
Figure 16H:
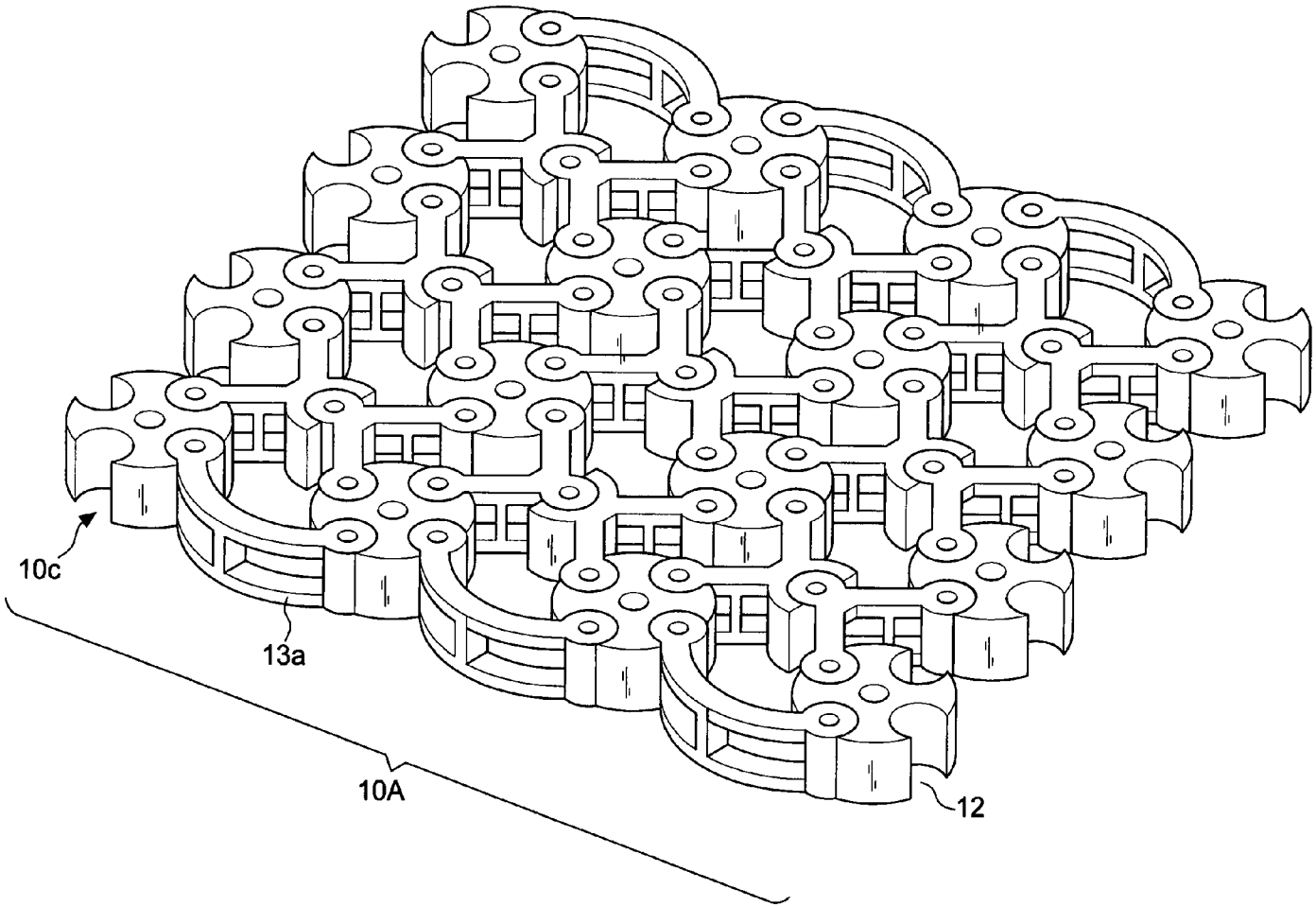

Regardless of being a light hollow component 10 or a heavy component 10*a*, 10*b*, the lattice units 10, 10A, 10B in accordance with the foregoing embodiments come with the same size and are formed integrally as a whole, but the invention is not limited to such arrangement only. In other words, the lattice unit of the invention can be the one as shown in FIGS. 16A~C, and comprises a large lattice unit 10A, 10B to go with a small lattice unit 10C, and it can be a lattice unit as shown in FIG. 16D and comprised of three different lattice units 10A, 10B, 10C coupled to form a plane layer 10A by a tenon joint assembling process. In addition, the lattice unit can be the one as shown in FIG. 16E and comprised of a small lattice unit 10C and a lattice 13*a* coupled with each other by a tenon joint assembling process to form a plane layer 10A. The perspective view as shown in FIG. 16F illustrates that the lattice 13*a* occupies a space with a specific height, and FIGS. 16G and 16H are planar view and perspective view of the arc shape of the tenon joint of the lattice 13*a* and the lattice units 10A, 10C. Therefore, the continuously extended lattice unit disclosed in the present invention is formed integrally as a whole or formed by building a convex tenon 11 and a concave tenon groove 12 onto two or more corresponding lattice units, such that the two lattice units can be coupled with each other by a tenon joint assembling process, so as to produce a structure with continuously extended lattice units.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A tenon joint type space lattice structure, comprising a plurality of interchangeable lattice units and at least one combining pillar, wherein:

a) each lattice unit comprises a plurality of pre-molded components each extending between respective end portions, a convex tenon and a concave tenon groove, the concave tenon groove having a cross-sectional circumferential arc, the convex tenon and concave tenon groove being respectively disposed on first and second ones of the end portions of the lattice unit, and the tenon and the tenon groove form a tenon-and-groove structure, the tenon groove of one lattice unit being configured to retentively capture the tenon of another lattice unit, a plurality of the lattice units being interconnectable with each other in series to define a continuously extended lattice unit plane layer; and b) the combining pillar interconnects a plurality of stacked plane layers, the combining pillar passing transversely through a hollow portion defined through respective lattice units of the stacked plane layers to form a three-dimensional space lattice structure, wherein each of the lattice units comprises a hollow lattice substantially forming a frame body, the hollow lattice including a plurality of erected and transversally and longitudinally interlaced sheet bodies disposed at each frame edge, the hollow tenon being formed at an end of each lattice along one of the sides of the lattice unit, the tenon groove with an opening facing outward being disposed at an end of each lattice along another side of the lattice unit.

2. The tenon joint type space lattice structure as recited in claim 1, wherein the frame body comprises a light hollow component made of at least one of: a resin matrix composite, metal base, inorganic non-metal base composite and plastic material.

3. The tenon joint type space lattice structure as recited in claim 1, wherein the combining pillar comprises a hollow or solid pillar made of at least one of: concrete, steel or the same material of the lattice unit.

4. The tenon joint type space lattice structure as recited in claim 1, wherein the three-dimensional space lattice structure further includes a soil and stone filling material filled into a hollow portion for earth fill vegetation.

5. The tenon joint type space lattice structure as recited in claim 1, wherein the lattice unit includes a heavy component made of a material selected from the group consisting of: of a metal, concrete and a wood.

6. The tenon joint type space lattice structure as recited in claim 1, wherein the three-dimensional space lattice structure further includes a heavy filling material filled into a hollow portion of the structure to form a gravity structure, the combining pillar being driven into a stratum or a foundation to form a cantilever structure.

* * * * *